US008695312B2

(12) United States Patent
Johnson et al.

(10) Patent No.: US 8,695,312 B2
(45) Date of Patent: Apr. 15, 2014

(54) FILM CLAMP AND RELATED METHODS AND APPARATUSES FOR WRAPPING LOADS

(75) Inventors: Richard L. Johnson, LaGrange, KY (US); David E. Eldridge, Fern Creek, KY (US); Jeremy McCray, Waddy, KY (US)

(73) Assignee: Lantech.com, LLC, Louisville, KY (US)

( * ) Notice: Subject to any disclaimer, the term of this patent is extended or adjusted under 35 U.S.C. 154(b) by 1016 days.

(21) Appl. No.: 12/473,191

(22) Filed: May 27, 2009

(65) Prior Publication Data

US 2009/0293435 A1 Dec. 3, 2009

Related U.S. Application Data

(60) Provisional application No. 61/071,964, filed on May 28, 2008.

(51) Int. Cl.
*B65B 13/02* (2006.01)

(52) U.S. Cl.
USPC ..... 53/399; 53/465; 53/587; 53/588; 53/589; 53/590; 269/32; 269/43

(58) Field of Classification Search
USPC ..... 53/399, 465, 582, 587–594; 269/22, 32, 269/43, 45, 71
See application file for complete search history.

(56) References Cited

U.S. PATENT DOCUMENTS

| | | | | |
|---|---|---|---|---|
| 4,432,185 | A | 2/1984 | Geisinger | |
| 4,563,863 | A | 1/1986 | Humphrey | |
| 4,761,934 | A | 8/1988 | Lancaster | |
| 4,972,656 | A | 11/1990 | Haugstad | |
| 4,989,909 | A * | 2/1991 | Bouligny et al. | 294/119.3 |
| 5,005,335 | A | 4/1991 | Yourgalite et al. | |
| 5,090,759 | A * | 2/1992 | Sato et al. | 294/119.3 |
| 5,168,691 | A | 12/1992 | Errani | |
| 5,564,258 | A | 10/1996 | Jones, Sr. et al. | |
| 5,657,972 | A * | 8/1997 | Blatt | 269/22 |

(Continued)

FOREIGN PATENT DOCUMENTS

| | | |
|---|---|---|
| DE | 27 17 647 | 11/1978 |
| DE | 38 20 048 A1 | 12/1989 |

(Continued)

OTHER PUBLICATIONS

PCT International Search Report and Written Opinion for PCT/US2009/045324, mailed Nov. 19, 2009.

(Continued)

*Primary Examiner* — Thanh Truong
*Assistant Examiner* — Eyamindae Jallow
(74) *Attorney, Agent, or Firm* — Wood, Herron & Evans, LLP

(57) ABSTRACT

An apparatus for clamping packaging material may include a packaging material holder. The packaging material holder may include a first jaw, a second jaw, opposing the first jaw, and a jaw opening between the first and second jaws. The jaw opening may be configured to receive a portion of packaging material. The packaging material holder may include an inflatable structure configured to fill at least a portion of the opening. The apparatus also may include a packaging material insertion tool configured to insert the portion of packaging material into the jaw opening for clamping.

85 Claims, 29 Drawing Sheets

(56) References Cited

U.S. PATENT DOCUMENTS

| | | | | |
|---|---|---|---|---|
| 5,941,049 | A | 8/1999 | Lancaster, III et al. | |
| 6,185,900 | B1 | 2/2001 | Martin et al. | |
| 6,189,291 | B1 | 2/2001 | Martin et al. | |
| 6,269,610 | B1 | 8/2001 | Lancaster, III et al. | |
| 6,293,074 | B1 | 9/2001 | Lancaster, III et al. | |
| 6,449,922 | B2 | 9/2002 | Lancaster, III et al. | |
| 6,516,591 | B1 | 2/2003 | Lancaster, III et al. | |
| 6,796,105 | B2 * | 9/2004 | Rossi | 53/399 |
| 6,848,237 | B2 | 2/2005 | Lancaster, III et al. | |
| 6,854,247 | B2 | 2/2005 | Lancaster, III et al. | |
| 6,892,436 | B2 * | 5/2005 | Yamaguchi et al. | 29/559 |
| 7,047,707 | B2 | 5/2006 | Lancaster, III et al. | |
| 7,089,713 | B2 | 8/2006 | Lancaster, III et al. | |
| 2003/0093974 | A1 * | 5/2003 | Rossi | 53/399 |
| 2005/0044812 | A1 | 3/2005 | Lancaster, III et al. | |
| 2005/0229544 | A1 * | 10/2005 | Casadei | 53/399 |
| 2007/0209324 | A1 | 9/2007 | Lancaster, III et al. | |
| 2008/0083306 | A1 * | 4/2008 | Castrale et al. | 81/492 |
| 2010/0037562 | A1 * | 2/2010 | Forni et al. | 53/461 |
| 2010/0164187 | A1 * | 7/2010 | Geng | 279/2.07 |

FOREIGN PATENT DOCUMENTS

| | | | |
|---|---|---|---|
| EP | 0 430 902 | B1 | 6/1984 |
| EP | 0 517 502 | A1 | 12/1992 |
| EP | 0 583 167 | A1 | 2/1994 |
| EP | 0 671 324 | A1 | 11/1994 |
| EP | 0 630 813 | A1 | 12/1994 |
| EP | 0 867 368 | A2 | 9/1998 |
| FR | 2 493 802 | | 5/1982 |
| FR | 2601612 | A1 * | 1/1988 |
| FR | 2 639 906 | | 6/1990 |
| GB | 2 014 107 | A | 8/1978 |
| GB | 2 216 489 | A | 10/1989 |
| WO | WO 99/06279 | | 2/1999 |

OTHER PUBLICATIONS

European Patent Office; Search Report and Written Opinion in International Patent Application No. PCT/US2011/058240 dated Feb. 3, 2012; 10 pages.

* cited by examiner

FILM CLAMP AND RELATED METHODS AND APPARATUSES FOR WRAPPING LOADS

This application claims priority under 35 U.S.C. §119 based on U.S. Provisional Application No. 61/071,964, filed May 28, 2008, the complete disclosure of which is incorporated herein by reference.

TECHNICAL FIELD

This disclosure relates generally to a method and apparatus for wrapping a load, and more particularly, to a method and apparatus for holding packaging material during the wrapping process.

BACKGROUND

Loads have been wrapped with packaging material by securing a leading end portion of the packaging material to the load or a turntable clamp, dispensing the packaging material, and providing relative rotation between the load and a packaging material dispenser to cause the load to be enveloped by the packaging material. The relative rotation can be provided several different ways. Either the load can be rotated on a turntable, or the dispenser can be rotated around the stationary load. Wrapping usually employs a web of packaging material as the packaging material.

Semi-automatic wrapping machinery requires the operator to attach a leading end portion of the packaging material to the load. This is typically accomplished by collapsing the leading end portion into a rope, then inserting the rope between the layers of the load or tying the end of the packaging material to the edge of the supporting wood pallet or any suitable outcropping on the load. This attachment must be relatively strong since it provides the resistance to pulling the packaging material from the packaging material dispenser during the initiation of the relative rotation between the load and the packaging material dispenser. The attachment or tying of the packaging material makes packaging material removal more difficult after the load has been shipped to its destination.

Automatic wrapping machines typically use packaging material clamps that grip the packaging material web between two opposed surfaces and use electrical or pneumatic actuators to open and close the clamps. Such packaging material clamps create a "tenting" effect during wrapping due to the distance between the clamp and the load during wrapping, resulting in wasted packaging material and loosely wrapped loads. Such clamps are expensive and may require costly maintenance for the electrical and mechanical actuators.

Other machines have used a vacuum device that uses suction to hold the packaging material. This arrangement grips the packaging material, but requires that the packaging material be placed in a flat manner against the vacuum device in order for the vacuum device to provide its full gripping force on the packaging material. Also, the vacuum device may damage the packaging material if the suction generated is too high, while the packaging material may be pulled off the vacuum device if the suction is too low. Furthermore, the vacuum device may have difficulty gripping a roped portion of the packaging material, where the strength of the packaging material is concentrated.

In light of these drawbacks, there is a need for a method and apparatus for wrapping a load with packaging material that operates as effectively as those previously developed but which can be manufactured at a lower cost.

SUMMARY

According to one aspect of the disclosure, an apparatus for clamping packaging material is provided. The apparatus may include a packaging material holder. The packaging material holder may include a first jaw, and a second jaw, opposing the first jaw. The packaging material holder may also include a jaw opening between the first and second jaws, configured to receive a portion of packaging material. The apparatus may also include a packaging material insertion tool configured to insert the portion of packaging material into the jaw opening for clamping.

According to another aspect of the disclosure, an apparatus for automatically positioning a leading end portion of a length of packaging material proximate a load is provided. The apparatus may include a packaging material holder including a jaw opening configured to receive the leading end portion. The apparatus may also include an insertion tool configured to insert the leading end portion into the jaw opening for clamping. The apparatus may further include a support arm configured to movably support the packaging material holder and allow movement of the packaging material holder toward the load to position the leading end portion proximate the load.

According to another aspect of the disclosure, an apparatus for automatically positioning a leading end portion of a length of packaging material proximate a load may include a packaging material holder including an opening. The packaging material holder may be mounted for linear travel in a direction transverse to a longitudinal axis of a conveyor for supporting the load. The apparatus may also include a finishing assembly configured for substantially linear travel. The finishing assembly may include a cutting assembly for cutting the packaging material to form a new leading end portion and a new tail end portion, a wipedown assembly configured to press the new tail end portion against the wrapped load, and an insertion tool configured to insert the new leading end portion into the opening of the packaging material holder.

According to another aspect of the disclosure, a method for automatically connecting a leading end portion of a length of packaging material to a load is provided. The method may include moving a packaging material holder clamping a leading end of the packaging material between jaws adjacent to a side of the load. The method may also include overwrapping the leading end. The method may further include releasing the overwrapped leading end. The method may further include automatically inserting a new leading end between the jaws with an insertion tool at an end of a wrapping cycle.

According to another aspect of the disclosure, a method for automatically clamping a leading end portion of a length of packaging material is provided. The method may include cutting a length of film extending from a corner of a wrapped load to a packaging material dispenser to form a leading end portion of packaging material extending from the packaging material in the packaging material dispenser, and a tail end portion extending to the wrapped load. The method may also include actuating an insertion tool to insert the leading end portion into a packaging material holder, and clamping the leading end portion with the packaging material holder.

According to another aspect of the disclosure, a method for wrapping a load with packaging material, is provided. The method may include positioning the load on a load support surface, pressurizing at least one inflatable bladder to engage the leading end portion within a packaging material holder, and moving the packaging material holder toward the load. The method may also include providing relative rotation between a packaging material dispenser and the load to wrap the packaging material around the load and the packaging material holder. The method may further include depressurizing the at least one inflatable bladder to release the leading end portion, and rotating the packaging material holder relative to the layers of packaging material wrapped around the load to move the packaging material holder away from the load.

According to another aspect of the disclosure, a method for wrapping a load with packaging material, is provided. The method may include positioning a leading end of film in a restricted jaw opening of a packaging material holder, and pressurizing at least one portion of the packaging material holder to fix the leading end relative to the restricted jaw opening. The method may also include wrapping packaging material around the load and the packaging material holder holding the leading end, and depressurizing the at least one portion of the packaging material holder to release the leading end.

According to yet another aspect of the disclosure, an apparatus for wrapping a load with packaging material is provided. The apparatus may include a packaging material holder. The packaging material holder may include a first jaw, a second jaw, opposing the first jaw, and a jaw opening between the first and second jaws. The jaw opening may be configured to receive a portion of packaging material. The apparatus may also include an assembly configured to engage the packaging material and insert the portion of packaging material into the jaw opening for clamping.

According to yet another aspect of the disclosure, a method for automatically clamping packaging material is provided. The method may include engaging at least a portion of a length of packaging material extending from a corner of a wrapped load to a packaging material dispenser with an assembly. The method may also include moving the engaged packaging material into a jaw opening between a first jaw and a second jaw of a packaging material holder. The method may also include clamping the engaged packaging material in the jaw opening of the packaging material holder According to yet another aspect of the disclosure, an apparatus for wrapping a load with packaging material is provided. The apparatus may include a packaging material holder. The packaging material holder may include a first inflatable element and a second inflatable element. The apparatus may also include an element configured to position packaging material between the first and second inflatable elements.

According to yet another aspect of the present disclosure, an apparatus for wrapping a load with packaging material is provided. The apparatus may include a packaging material holder. The packaging material holder may include a substantially rigid element including an opening, and at least one inflatable element configured to at least partially fill the opening. The apparatus may include an element configured to position packaging material in the opening.

According to yet another aspect of the present disclosure, a method for wrapping a load with packaging material is provided. The method may include pressurizing at least one inflatable element to at least partially fill an opening in a rigid element of a packaging material holder, and positioning packaging material in the opening with an element.

Additional aspects and advantages of the disclosure will be set forth in the description which follows, and in part will be apparent from the description, or may be learned by practice of the disclosure. The aspects and other advantages of the disclosure will be realized and attained by the method and apparatus particularly pointed out in the written description and claims as well as the appended drawings.

It is to be understood that both the foregoing general description and the following detailed description are exemplary and explanatory and are intended to provide further explanation of the disclosure as claimed. The accompanying drawings are included to provide a further understanding of the disclosure and are incorporated in and constitute a part of the specification, illustrate an embodiment of the disclosure, and together with the description serve to explain the principles of the disclosure.

DETAILED DESCRIPTION

Figure 1:
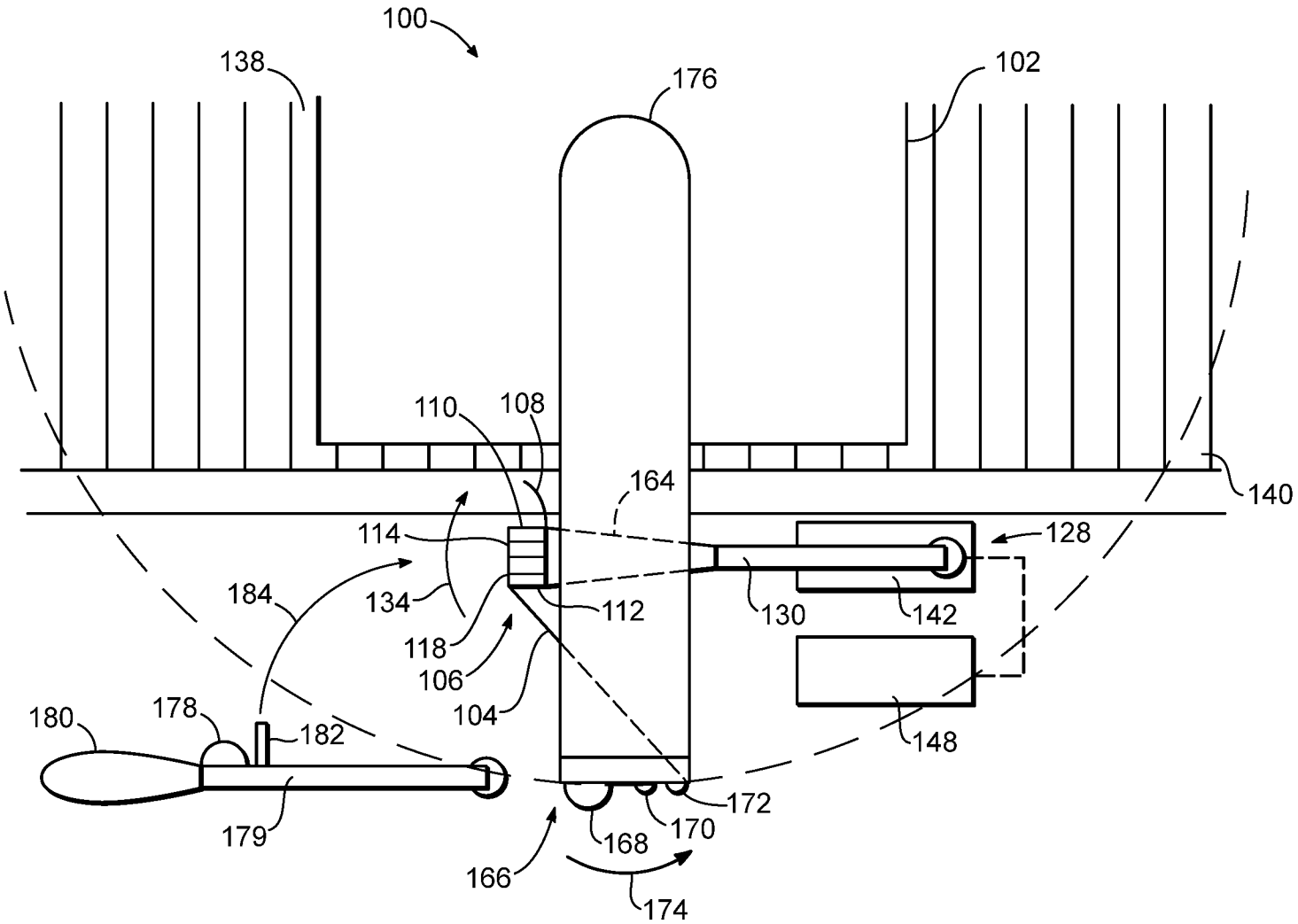
FIG. 1 is a top view of components of a wrapping apparatus, according to one aspect of the present disclosure.
Figure 2:
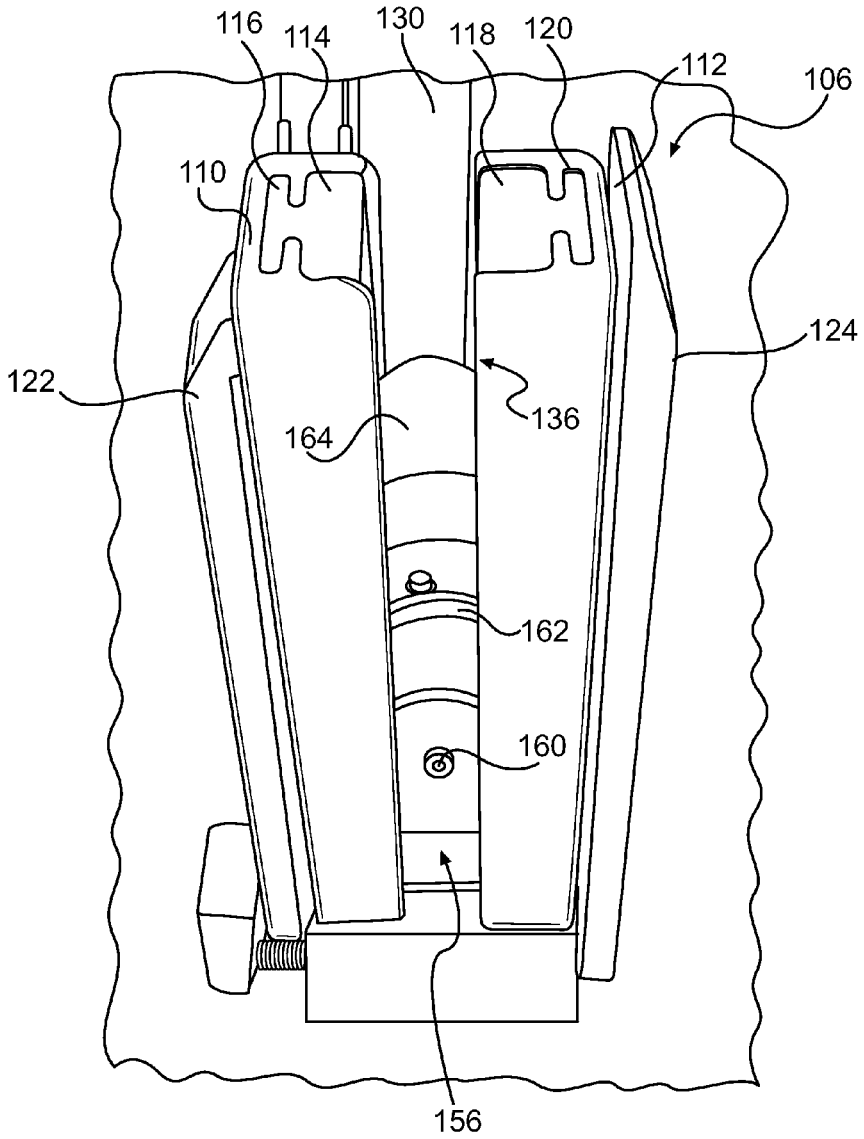
FIG. 2 is a perspective view of a packaging material holder of the wrapping apparatus of FIG. 1, according to one aspect of the present disclosure.

Reference will now be made to the present embodiments of the disclosure, examples of which are illustrated in the accompanying drawings. Wherever possible, the same reference numbers will be used throughout the drawings to refer to the same or like parts.

According to the disclosure, and as shown in FIGS. 1-11, an apparatus 100 is provided for wrapping a load 102 with packaging material 104. Apparatus 100 may include a packaging material holder 106 for selectively holding and releasing a leading end portion 108 of packaging material 104. Packaging material holder 106 may have a substantially rectangular shape. However, it is contemplated that other alternatives, such as a square shape, and/or curved shapes, may be used. Packaging material holder 106 may include a first jaw 110, and a second jaw 112 that opposes first jaw 110. First jaw 110 and second jaw 112 may be fixed relative to each other, or may be part of a single body. A space between first jaw 110 and second jaw 112 may form a restricted jaw opening 136. As used herein, the phrase "restricted jaw opening" is defined as a jaw opening with substantially fixed dimensions, regardless of whether the jaws forming the restricted jaw opening are gripping or releasing packaging material. Thus, restricted jaw opening 136 may have fixed dimensions, regardless of whether packaging material holder 106 is gripping packaging material 104, due to first jaw 110 and second jaw 112 being fixed relative to each other. Restricted jaw opening 136 may be restricted in that first jaw 110 and second jaw 112 do not open to form an angle or clearance between their opposing surfaces when receiving packaging material 104 for clamping, or when freeing themselves from overwrapped layers of packaging material 104.

The dimensions of restricted jaw opening 136 may vary depending on several factors. For example, restricted jaw opening 136 may be large enough so that a length of packaging material 104 that is received therein does not slip out of restricted jaw opening 136 during clamping. Restricted jaw opening 136 may be small enough so that packaging material holder 106, which defines restricted jaw opening 136, can be moved away from load 102, and out from underneath one or more layers of packaging material 104 wrapped around load 102, without damaging the wrapped layers of packaging material 104, damaging the integrity of load 102, and/or requiring excessive forces to accomplish the movement. It is contemplated that in one embodiment, the space defined by restricted jaw opening 136 may have a height of between approximately 5 inches to 8 inches, for receiving a length of approximately 5 inches to 8 inches of a 20 inch to 30 inch tall web of packaging material 104. That 5 inches to 8 inches of packaging material 104 may include a roped or rolled cable portion of packaging material 104. It should be understood that when packaging material 104 is manually gathered or collapsed, the entire manually gathered or collapsed portion of packaging material 104 may be received in restricted jaw opening 136. It is also contemplated that in one embodiment, the spaced defined by restricted jaw opening 136 may have a width of approximately ⅝ inches.

First jaw 110 may include a first inflatable bladder 114 mounted thereon. For example, first inflatable bladder 114 may be mounted in a recess, opening, or channel 116 in first jaw 110. In one embodiment, channel 116 may extend longitudinally along first jaw 110, and away from restricted jaw opening 136. Alternatively, first inflatable bladder 114 may be mounted on or attached to a surface of first jaw 110 without being received in a channel. For example, first inflatable bladder 114 may be attached to first jaw 110 with an adhesive, bracket, and/or any other suitable attachment member.

Second jaw 112 may include a second inflatable bladder 118 mounted thereon. For example, second inflatable bladder 118 may be mounted in a recess, opening, or channel 120 in second jaw 112. In one embodiment, channel 120 may extend longitudinally along second jaw 112, and away from restricted jaw opening 136. Alternatively, second inflatable bladder 118 may be mounted on or attached to a surface of second jaw 112 without being received in a channel. For example, second inflatable bladder 118 may be attached to second jaw 112 with an adhesive, bracket, and/or any other suitable attachment member.

First inflatable bladder 114 and second inflatable bladder 118 may be made of an elastomeric material, such as, for example, rubber. First inflatable bladder 114 and second inflatable bladder 118 may extend longitudinally in substantially the same direction as first jaw 110 and second jaw 112, respectively, and each may have a height of between approximately 5 inches to 8 inches. Other size bladders may be used depending upon the size of the space defined by restricted jaw opening 136, and the number of bladders used to occlude the opening.

When pressurized, first inflatable bladder 114 may expand toward second jaw 112, and pressurization of second inflatable bladder 118 may cause it to expand toward first jaw 110. As the first and second inflatable bladders 114 and 118 expand, they may fill or occlude the spaced defined by restricted jaw opening 136. Thus, when first inflatable bladder 114 and second inflatable bladder 118 are pressurized, their opposing surfaces may come into contact with one another in restricted jaw opening 136, and these opposing surfaces may exert a clamping or trapping force on leading end 108 of packaging material 104 when it is positioned in restricted jaw opening 136 while bladders 114 and 118 are pressurized. The clamping or trapping force is a product of bladders 114 and 118 being expanded within restricted jaw opening 136. Since the space between jaws 110 and 112 is fixed, bladders 114 and 118 push against one another, eliminating the space between bladders 114 and 118.

Leading end 108 of packaging material 104 may include a portion of packaging material 104 that has been manually gathered or collapsed, and that gathered or collapsed portion may include substantially the entire height of packaging material 104. Alternatively, leading end 108 may include a portion of packaging material 104 that has been roped or rolled into a cable, and another portion that has a non-roped or rolled configuration. It is contemplated that in one embodiment, the roped or rolled portion of packaging material 104 may include between approximately 3 to 5 inches of packaging material 104. However, it is possible for any suitable amount of packaging material to be held within packaging material holder 106—e.g., any amount that will allow packaging material holder 106 to hold packaging material 104 during start-up of a wrapping cycle.

First inflatable bladder 114 and second inflatable bladder 118 are shown in the pressurized condition in FIGS. 1, 3, 4, 6, 7, 10 and 11. The clamping force may be suitable for holding leading end 108 of packaging material 104 and preventing its withdrawal from restricted jaw opening 136 under forces exerted on packaging material 104 during the wrapping process. The clamping action of first inflatable bladder 114 and second inflatable bladder 118 may be enhanced by frictional engagement between the bladder material and packaging material 104. Accordingly, the bladder material may be selected based on its ability to enhance the frictional engagement, as well as its ability to expand when pressurized. When first inflatable bladder 114 and second inflatable bladder 118 are depressurized, they may be contained within their respective channels 116 and 120 (i.e., not extend beyond their respective channels), and thus, will not hold packaging material 104 in restricted jaw opening 136. Alternatively, first inflatable bladder 114 and second inflatable bladder 118 may be depressurized to a point where packaging material 104 may be released, while at least one of first inflatable bladder 114 and second inflatable bladder 118 extend at least partially into restricted jaw opening 136.

First inflatable bladder 114 and second inflatable bladder 118 are shown in a depressurized condition in FIGS. 2, 5, 8, and 9. Depressurization allows packaging material 104 to be removed from restricted jaw opening 136. Alternatively, only one of first jaw 110 and second jaw 112 may include an inflatable bladder of a sufficient size to fully occlude restricted jaw opening 136 or occlude enough of restricted jaw opening 136 to clamp packaging material 104, and the other of first jaw 110 and second jaw 112 may include a surface for engaging the inflatable bladder to hold packaging material 104 within restricted jaw opening 136.

First jaw 110 and second jaw 112 may include low friction outer surfaces. The low friction outer surfaces may be made from a non-stick material, such as Teflon™, or smooth metal, to minimize any undesirable frictional engagement between the outer surfaces and packaging material 104. Additionally or alternatively, first jaw 110 and/or second jaw 112 may have low-friction panels 122 and 124, shown in FIGS. 2 and 7-11, attached to their outer surfaces to minimize frictional engagement between the outer surfaces and packaging material 104.

Figure 5:
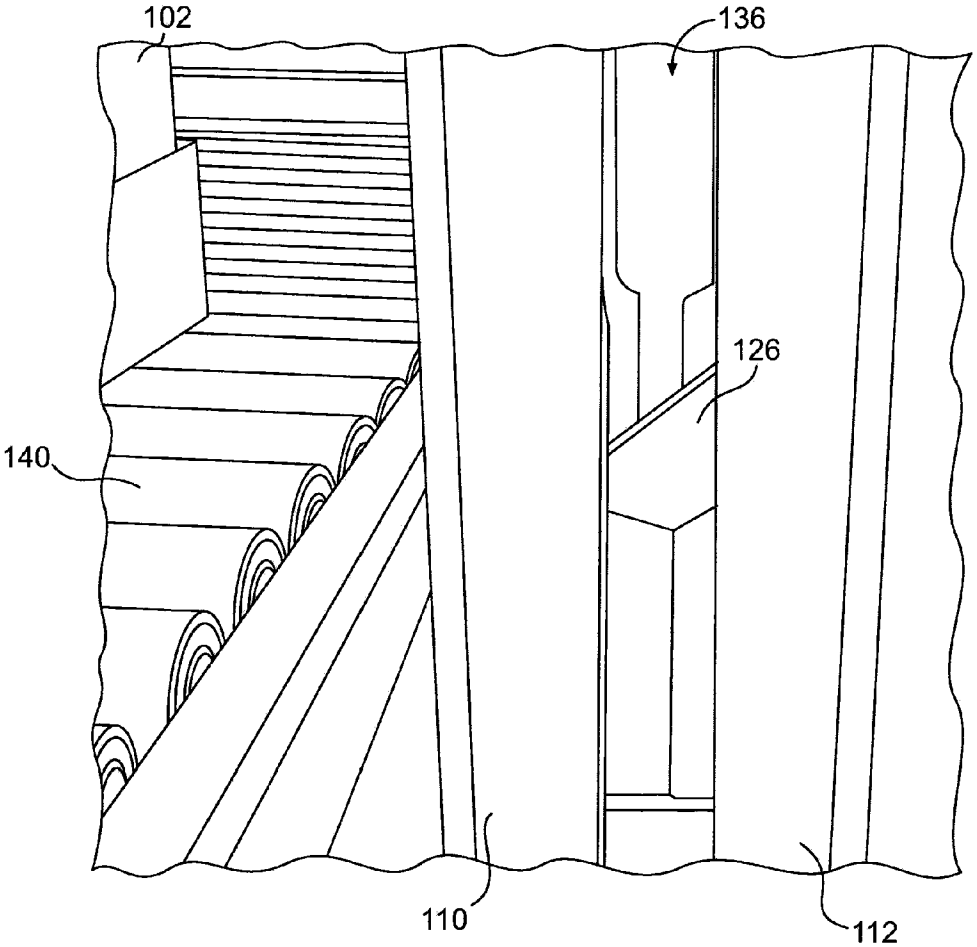
FIG. 5 is another perspective view of components of the wrapping apparatus of FIG. 1, according to one aspect of the present disclosure.
Figure 6:
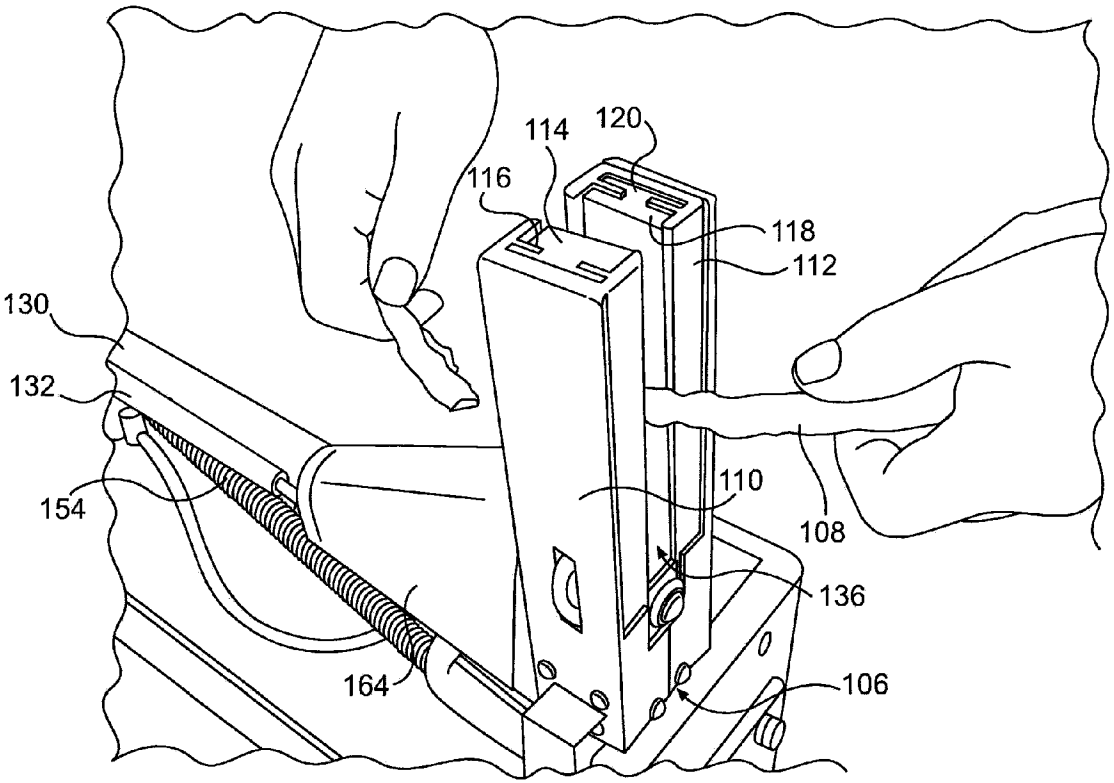
FIGS. 6-11 are sequential perspective views of the packaging material holder of the wrapping apparatus of FIG. 1 in use, according to one aspect of the present disclosure.

Packaging material holder 106 may include a packaging material cutter 126, shown in FIG. 5, mounted on a side portion of packaging material holder 106. Packaging material cutter 126 may include a blade or similar cutting device. Prior to wrapping load 102, such as, for example, after loading of a new roll of packaging material 104 in packaging material dispenser 166, a user may grasp a portion of packaging material 104 extending from packaging material dispenser 166, and may manually gather or collapse the portion. The user may insert the gathered or collapsed portion into restricted jaw opening 136, where it may be held during at least an initial portion of a wrapping cycle. The user may use cutter 126 to sever the gathered or collapsed portion after insertion, as shown in FIG. 6, so that any excess packaging material is removed before wrapping begins.

Figure 3:
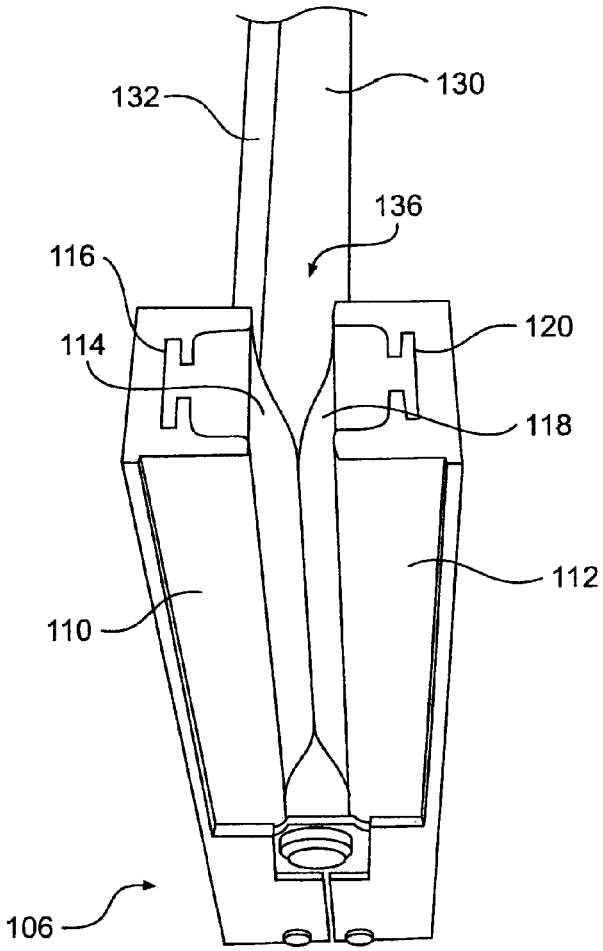
FIG. 3 is another perspective view of a packaging material holder of the wrapping apparatus of FIG. 1, according to one aspect of the present disclosure.

To facilitate this insertion of packaging material 104, first inflatable bladder 114 and second inflatable bladder 118 may be shaped such that when pressurized, a gap exists between their upper portions, allowing a manually gathered or collapsed portion of packaging material 104 to be forced down between first inflatable bladder 114 and second inflatable bladder 118 while they are pressurized. Additionally or alternatively, top portions of first inflatable bladder 114 and second inflatable bladder 118 may be sloped to facilitate insertion of the gathered or collapsed portion, as shown in FIG. 3. Insertion of the gathered or collapsed portion may be necessary, for example, when a new roll 168 of packaging material 104 is placed in packaging material dispenser 166.

A support arm assembly 128 may be provided for moving packaging material holder 106 toward or away from load 102, which may be positioned on a load support surface 138, such as a conveyor 140 (see FIGS. 1, 4, 5, 7, 9, 10 and 11). As embodied herein and as shown in FIGS. 1-4, 6-8, 10, and 11, support arm assembly 128 may include a support arm 130 configured to support packaging material holder 106. Support arm 130 may include a metal tube. Alternatively, support arm 130 may include any other structure suitable for supporting and moving packaging material holder 106, such as a bar, a frame, a wire structure, a telescoping element, or a truss. Support arm 130 may be made from any suitable material strong enough to support and move packaging material holder 106, such as wood or other fibrous materials, plastics, metals, or composites of any of these materials.

Figure 4:
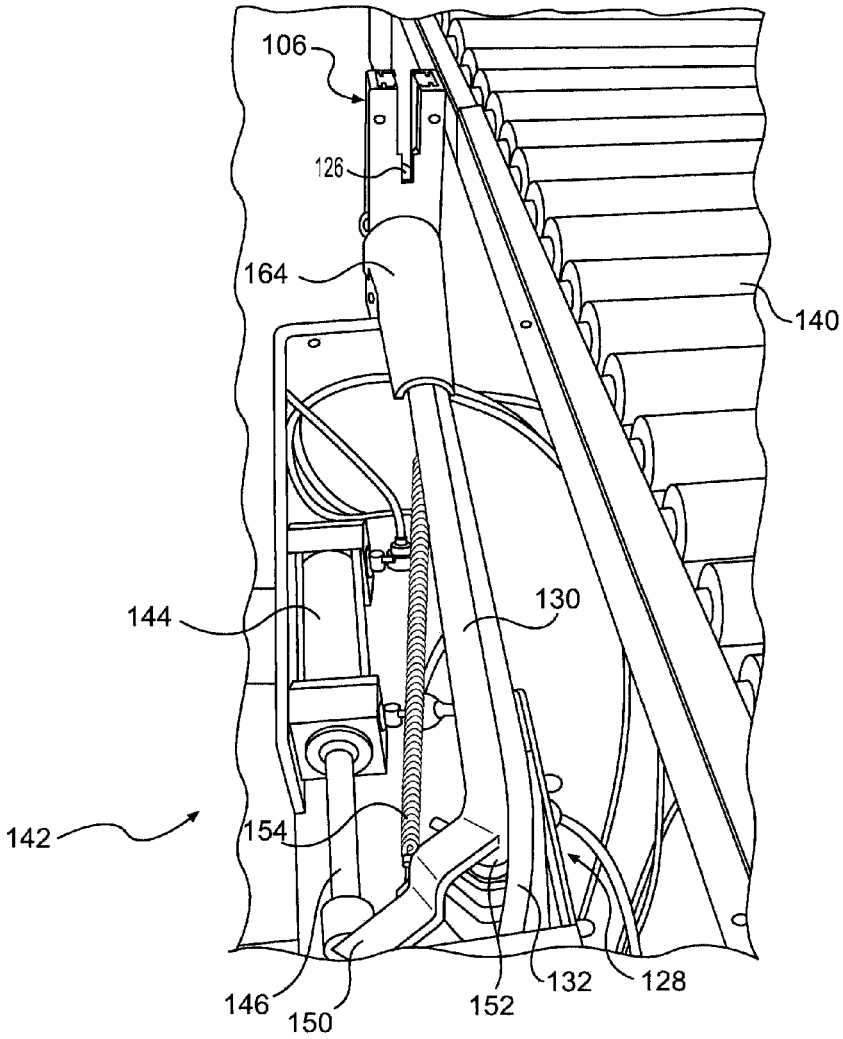
FIG. 4 is a perspective view of components of a packaging material holder of the wrapping apparatus of FIG. 1, according to one aspect of the present disclosure.

Support arm 130 may be coupled to a fluid conduit 132, as shown in FIG. 4. Fluid conduit 132 may be in fluid communication with first inflatable bladder 114, second inflatable bladder 118, and a pressurized fluid supply (not shown). Fluid conduit 132 may be configured to direct pressurized fluid into first inflatable bladder 114 and second inflatable bladder 118 to pressurize them, and out of first inflatable bladder 114 and second inflatable bladder 118 to depressurize them.

Figure 7:
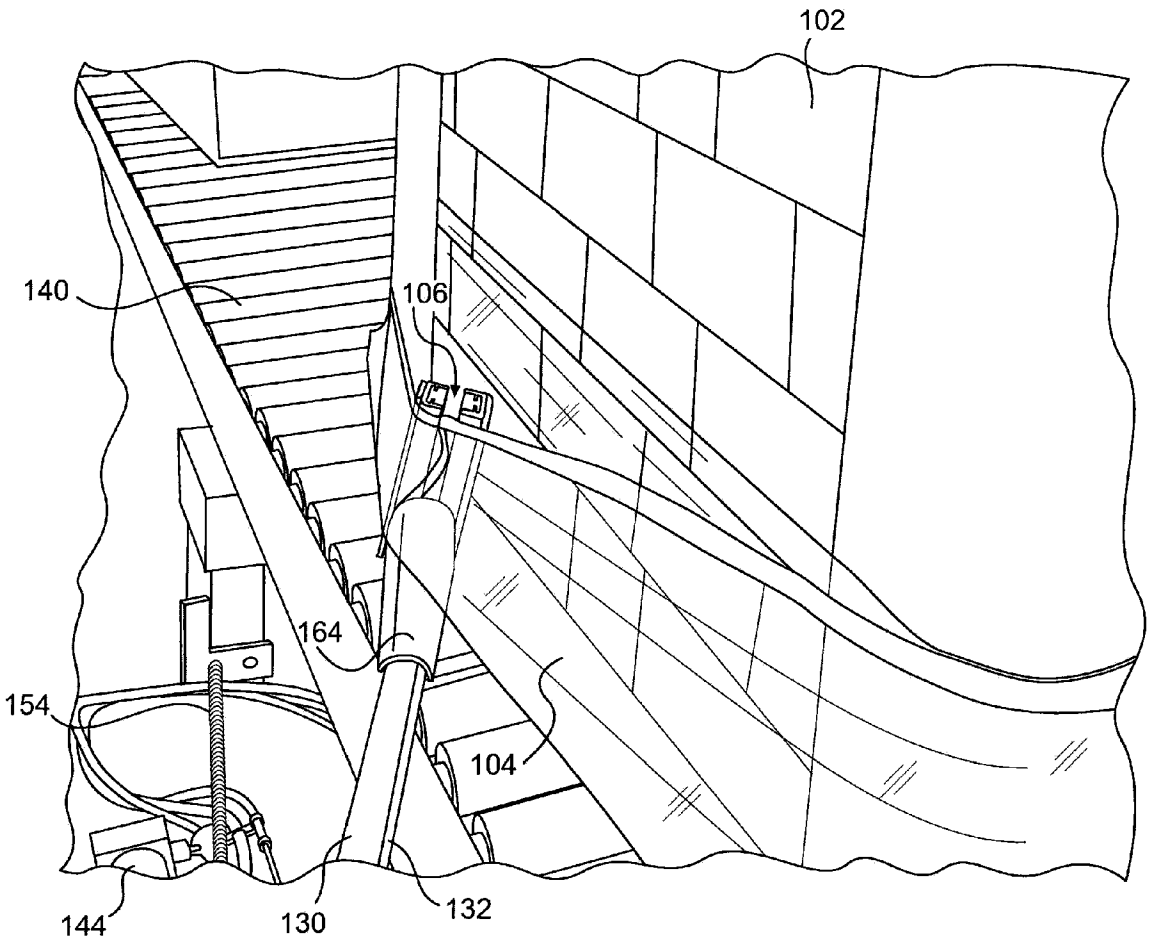
Figure 8:
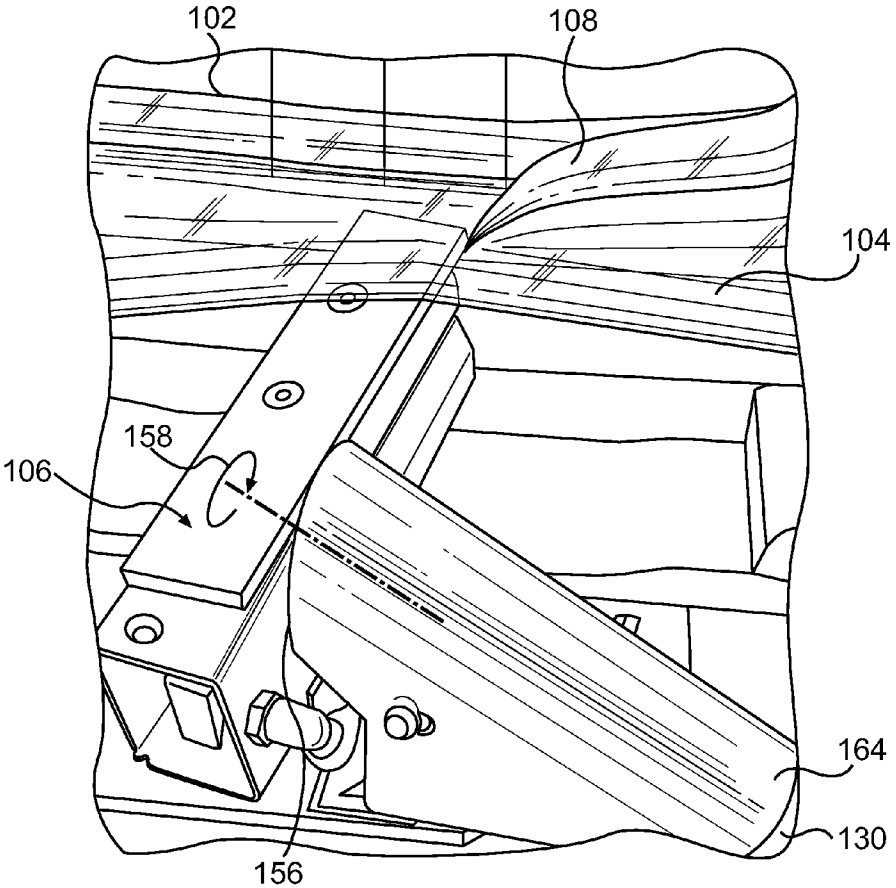

Support arm 130 may be rotatable, and as such, may move packaging material holder 106 between a position distant from load 102, near packaging material dispenser 166 (shown in FIGS. 1-6 and 9-11, for example), and a position touching or near load 102 (shown in FIGS. 7 and 8, for example). With respect to an axis of rotation for wrapping load 102, the distant position may be a radially outward position, while the near position may be a radially inward position. The near and distant positions may be defined with respect to a circle circumscribed about the corners of load 102. The interior area of the circle may be the area into which packaging material holder 106 and support arm 130 pass to reach the near position. In contrast, when packaging material holder 106 and support arm 130 are outside this circle, they may be in the distant position. Support arm 130 may rotate between the distant and near positions in the direction shown by an arrow 134, shown in FIG. 1, and may rotate between the near and distant positions in a direction opposite that of arrow 134.

Support arm 130 may be moveable above load support surface 138. As embodied herein, load support surface 138 may include the surface that supports load 102 during the wrapping process. As shown in FIGS. 1, 4, 5, 7, and 9-11, load support surface 138 may include a portion of conveyor 140 upon which load 102 rests during wrapping. Alternatively, load support surface 138 may be the floor, a portion of a rotatable turntable, or any other surface upon which a load may rest during wrapping.

Support arm 130 may swing through an arc in a horizontal plane above load support surface 138 as it moves packaging material holder 106 back and forth between the distant and near positions. Alternatively, support arm 130 may slide on top of load support surface 138 as it moves packaging material holder 106 back and forth between the distant and near positions. Movement of support arm 130 may be driven by an arm actuation assembly 142, shown in FIGS. 1, 4, 6, 7, 10, and 11, which may include, for example, a hydraulic or pneumatic cylinder 144 for receiving pressurized fluid, and a piston 146 configured to extend and retract in response to forces generated in cylinder 144. The extension and retraction of piston 146 may be controlled by a controller 148. When piston 146 is extended, it comes into contact with a leg portion 150 of support arm 130, causing support arm 130 to rotate about a pivot 152 from the near position to the distant position. When piston 146 is retracted, a spring 154 mounted on one end to leg portion 150, and on another end to a fixed portion of support arm assembly 128, may bias support arm 130 so as to move support arm 130 toward the near position. Movement of support arm 130 from the distant position to the near position may be assisted by the force exerted on packaging material holder 106 by packaging material 104 during the wrapping cycle.

As shown in FIGS. 2, 8, 9, and 10, support arm assembly 128 may include a rotatable hinged wrist portion 156. Through wrist portion 156, support arm 130 may be movably coupled to packaging material holder 106. Wrist portion 156 may include a rod 160 rotatably coupled to support arm 130 and attached to packaging material holder 106, to allow rotation of packaging material holder 106 relative to support arm 130 between an upright position (shown, for example, in FIGS. 1-7 and 9-11) and a rotated position (shown, for example in FIG. 8), in the direction of an arrow 158. Wrist portion 156 may also include a biasing mechanism, such as, for example, a spring 162 located between and attached to support arm 130 and packaging material holder 106, configured to bias packaging material holder 106 toward the upright position. Alternatively, rotation of wrist portion 156 may be actuated by an air cylinder or piston (not shown), or rotation may be driven by unpowered force such as movement of support arm 130 by pulling away from packaging material holder 106. Wrist portion 156 may include any suitable device for providing articulation between support arm 130 and packaging material holder 106 such as a hinge, a ball, or a ball and socket combination. Wrist portion 156 may be made from any material which provides the necessary strength and flexibility to allow articulation between support arm 130 and packaging material holder 106 while facilitating the support of packaging material holder 106 on support arm 130. Examples of suitable materials are metals, plastics, rubbers, and other polymers.

While in the upright position, packaging material holder 106 may hold packaging material 104 above support arm 130. Support arm 130 and packaging material holder 106 are thus arranged such that packaging material holder 106 holds the packaging material 104 away from support arm 130 so that support arm 130 does not engage the packaging material or interfere with the wrapping process. It is also contemplated that support arm assembly 128 may include a guard 164, as shown in FIGS. 1, 2, 4, and 6-11, mounted on a portion of support arm 130 proximate packaging material holder 106 and wrist portion 156. Guard 164 may be configured to protect wrist portion 156 from debris, and/or may include a curved top surface configured to allow packaging material 104 to slide up and over guard 164, to prevent packaging material 104 from catching on support arm 130 and being damaged.

A packaging material dispenser 166 may be provided for dispensing packaging material 104. Packaging material dispenser 166 may dispense a sheet of packaging material 104 in a web form. Packaging material dispenser 166 may house a roll 168 of packaging material 104, and may also include one or more packaging material dispensing rollers 170 and 172. Packaging material dispensing rollers 170 and 172 may include prestretch rollers for stretching the packaging material 104 longitudinally and/or transversely, to position, dispense, and stretch packaging material 104 as it is being dispensed from roll 168. Packaging material dispenser 166 may be vertically moveable relative to load 102, in addition to being rotatable relative to load 102 in the direction indicated by arrow 174. This combination of vertical and rotating movement allows packaging material dispenser 166 to wrap packaging material 104 spirally about load 102. While stretch wrap packaging material is described here, it should be understood that various other packaging material such as non-stretch wrap, netting, strapping, banding, or tape can be used as well. Further, it should be understood that packaging material is also commonly referred to as film, web, or film web, and such terms are interchangeable with "packaging material."

Apparatus 100 may also include a relative rotation assembly 176, in this case, a rotatable arm, as shown in FIG. 1, for rotating packaging material dispenser 166 relative to load 102. The rotatable arm may be L-shaped, and may be rotated by a motor (not shown). Packaging material dispenser 166 may be configured to travel vertically along a portion of the L-shaped rotatable arm to provide the vertical movement associated with spiral wrapping.

Apparatus 100 may also include means for severing packaging material 104 between load 102 and packaging material holder 106. As shown in FIGS. 1 and 9-11, the means for severing may include a cutting assembly 178 having a hot wire or blade that acts to heat and/or sever packaging material 104 as packaging material 104 extends between packaging material dispenser 166 and load 102. Cutting assembly 178 may be mounted on a rotatable body 179, which may in turn be mounted on a mast (not shown) supporting the rotatable arm, on packaging material dispenser 166, or on any other suitable support. Rotatable body 179 may be rotated by any suitable actuation means, including, for example, components similar to those in actuation assembly 142. When cutting assembly 178 severs packaging material 104, one side of packaging material 104 that is attached to load 102 may become a tail end portion 107, while the other side may become a new leading end portion 108. Cutting assembly 178 may be used to cut packaging material 104 as a step in a process for automated loading of packaging material 104 in packaging material holder 106, while cutting element 126 may be used to cut packaging material 104 as a step in a process for manual loading of packaging material 104 in packaging material holder 106.

Apparatus 100 may further include a wipedown assembly 180, shown in FIG. 1 for wiping tail end portion 107 onto load 102 after packaging material 104 has been cut. Wipedown assembly 180 may include wipe loops and/or a wipe arm, and may be mounted on rotatable body 179. Cutting assembly 178 and wipedown assembly 180 may be positioned to allow tail end portion to be wiped onto load 102 as packaging material 104 is cut.

Cutting assembly 178 and/or wipedown assembly 180 may also be coupled to an insertion tool 182, also mounted on rotatable body 179. As shown in FIGS. 1 and 9-11, rotatable body 179, and thus, cutting assembly 178, wipedown assembly 180, and insertion tool 182 mounted thereon, may be configured to rotate toward load 102 and packaging material holder 106 in the direction of an arrow 184. This rotational movement may take place as packaging material holder 106 occupies the distant position. It is also contemplated that rotatable body 179, cutting assembly 178, wipedown assembly 180, and/or insertion tool 182, may rotate out of the way of relative rotation assembly 176 and packaging material dispenser 166 (i.e., away from load 102 in the direction opposite arrow 184) during an intermediary portion of the wrapping cycle, and may rotate back into position to cut, wipedown, and/or insert during an end portion of the wrapping cycle. As such, rotatable body 179 and cutting assembly 178, wipedown assembly 180, and/or insertion tool 182 may form a rotation assembly.

Figure 9:
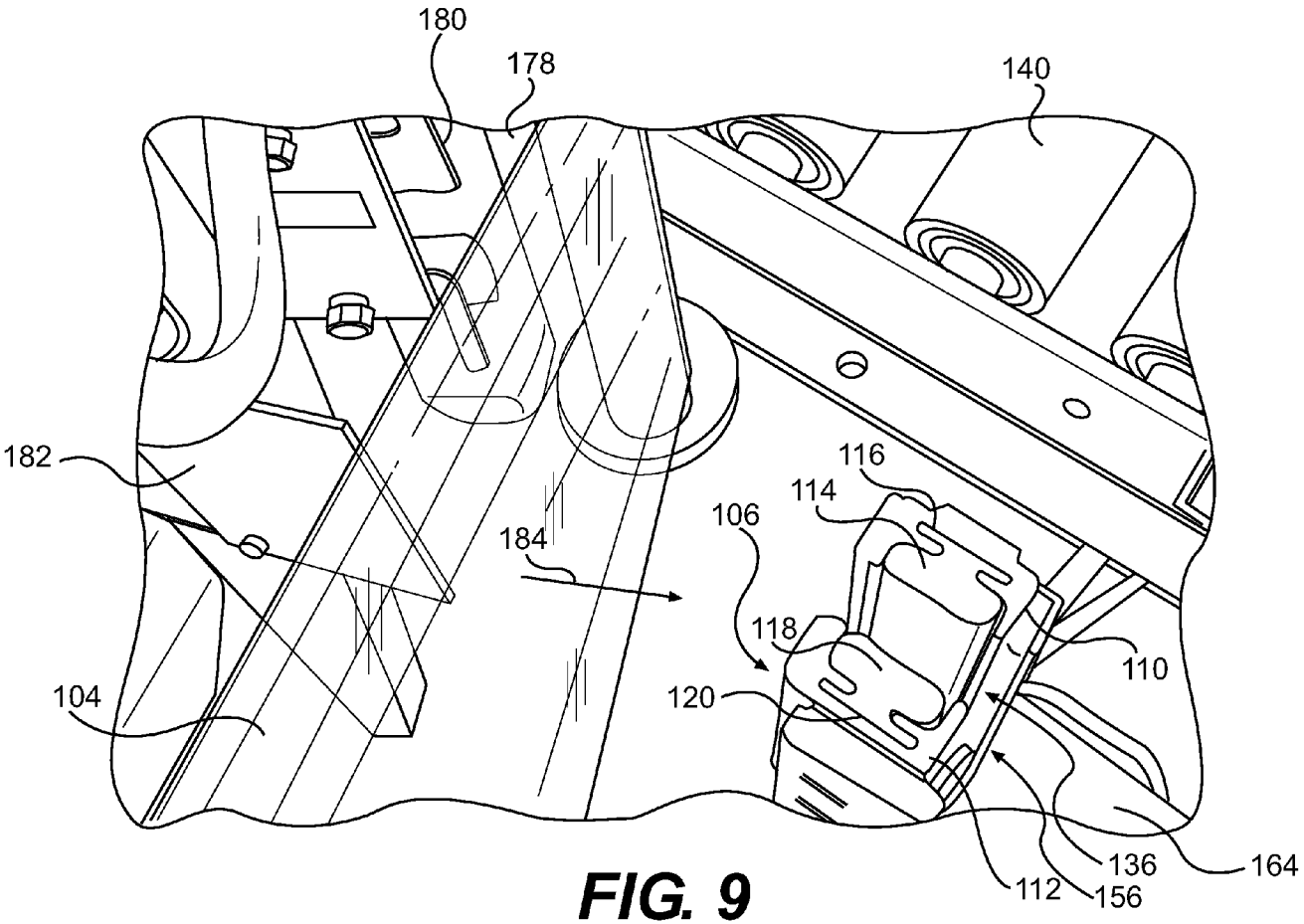

During the end portion of the wrapping cycle, packaging material 104 may extend from a corner of load 102 to packaging material dispenser 166, as shown in FIG. 9. Cutting assembly 178 and wipedown assembly 180 may cut packaging material 104 and wipe tail end portion 107 onto load 102. Insertion tool 182 may engage a portion of packaging material 104. Insertion tool 182 may move the engaged portion of packaging material 104 into restricted jaw opening 136. The engaged portion of packaging material 104 may include new leading end portion 108. Once inserted into restricted jaw opening 136, at least a portion of the engaged portion of packaging material 104 may be clamped by first inflatable bladder 114 and second inflatable bladder 118. Also during the end portion of the wrapping cycle, packaging material 104 may be roped by a roping assembly (not shown), for example, in the manner described in U.S. patent application Ser. No. 10/767,863, titled "METHOD AND APPARATUS FOR SECURING A LOAD TO A PALLET WITH A ROPED FILM WEB", filed Jan. 30, 2004, and Ser. No. 11/709,879, titled "METHOD AND APPARATUS FOR SECURING A LOAD TO A PALLET WITH A ROPED FILM WEB", filed Feb. 23, 2007, the entire disclosures of which are incorporated herein by reference. Thus, new leading end portion 108 may be at least partially formed into a rope prior to insertion into restricted jaw opening 136, allowing the roped portion to be gripped between first inflatable bladder 114 and second inflatable bladder 118 of packaging material holder 106. Also, at least a portion of tail end portion 107 may be formed into a rope of packaging material.

Bladders 114 and 118 may be depressurized when insertion tool 182 forces new leading end portion 108 into restricted jaw opening 136. After leading end portion 108 has been inserted, bladders 114 and 118 may be fully pressurized. It is contemplated that at full pressurization, bladders 114 and 118 may exert approximately 8 pounds of pressure on leading end portion 108. Alternatively, at least one of bladders 114 and 118 may be at least partially pressurized before or during the period where insertion tool 182 forces new leading end portion 108 into restricted jaw opening 136, such that insertion tool 182 and/or new leading end portion 108 may engage at least one of bladders 114 and 118 during insertion.

Figure 10:
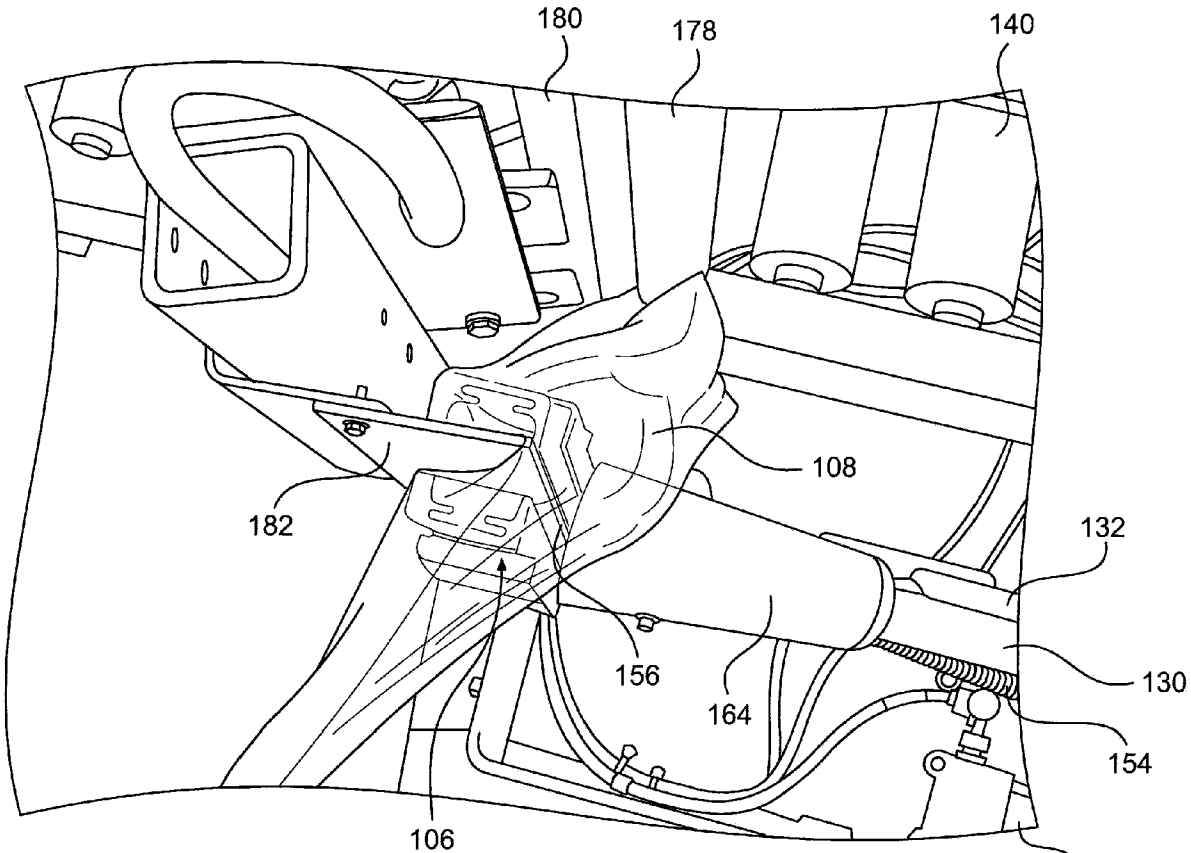
Figure 11:
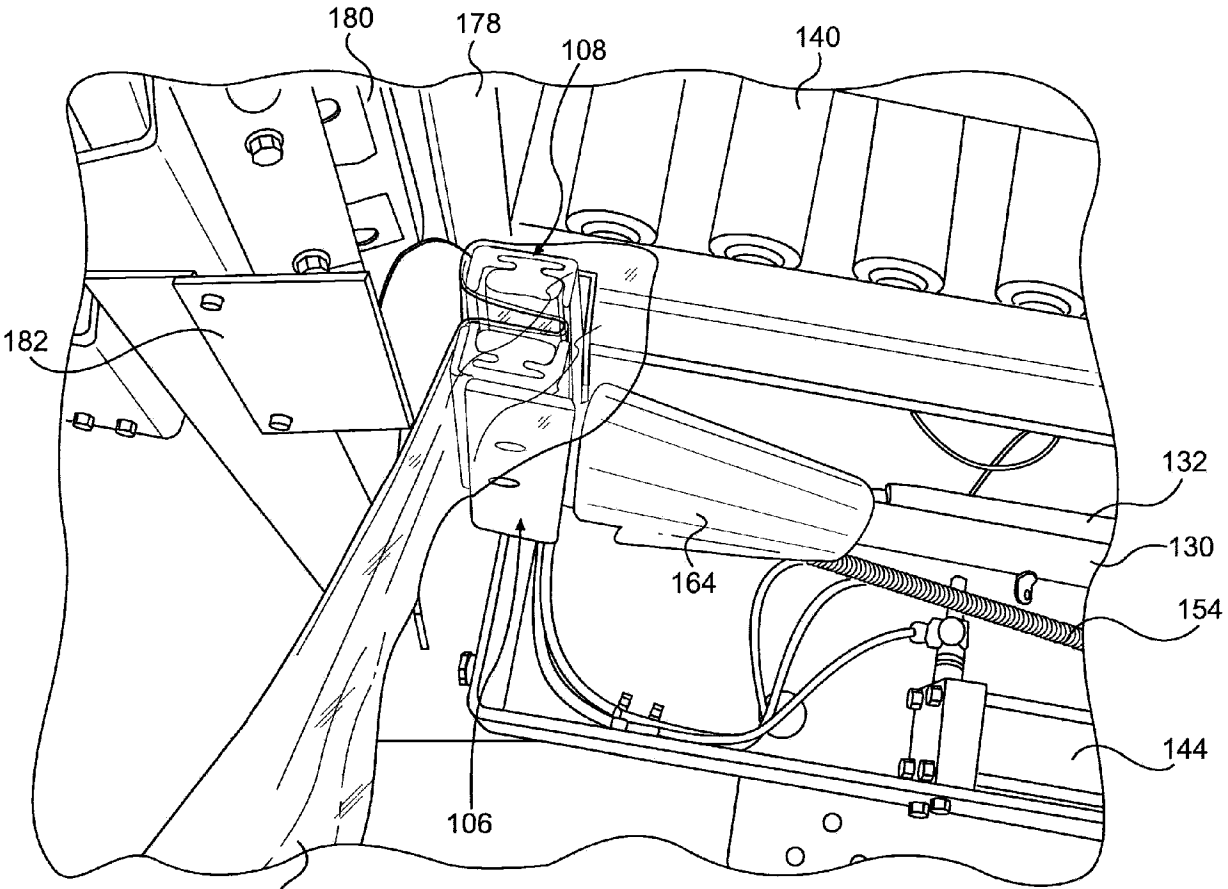
Figure 21:
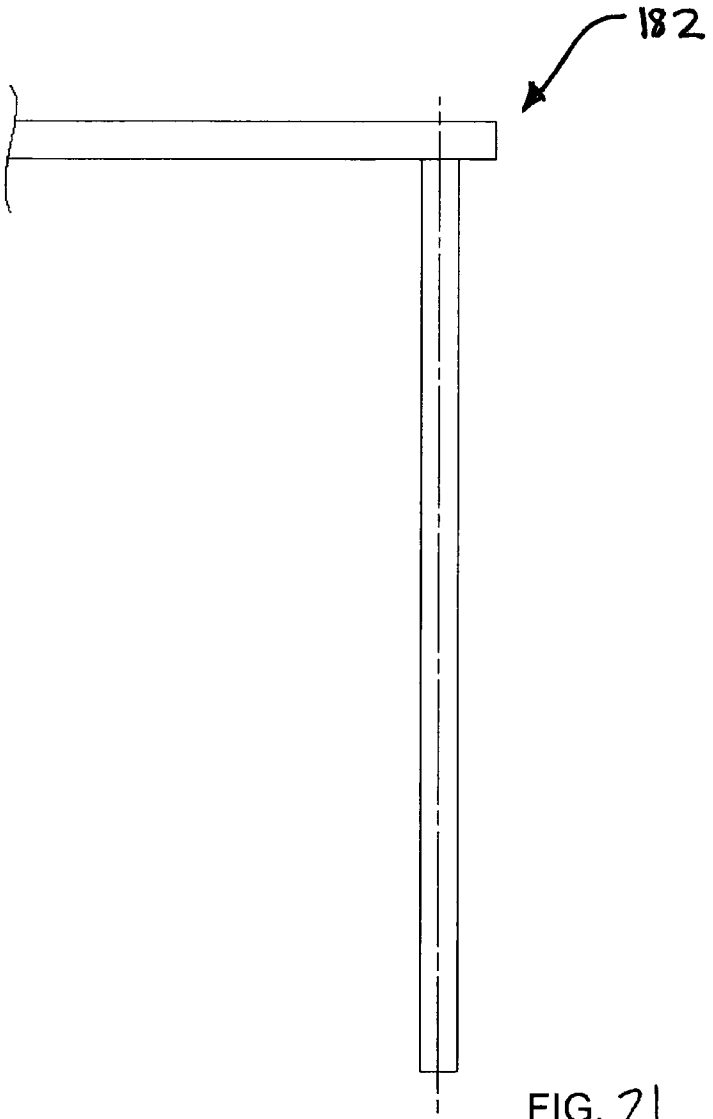
FIG. 21 is a side view of a component of a wrapping apparatus, according to one aspect of the present disclosure.
Figure 22:
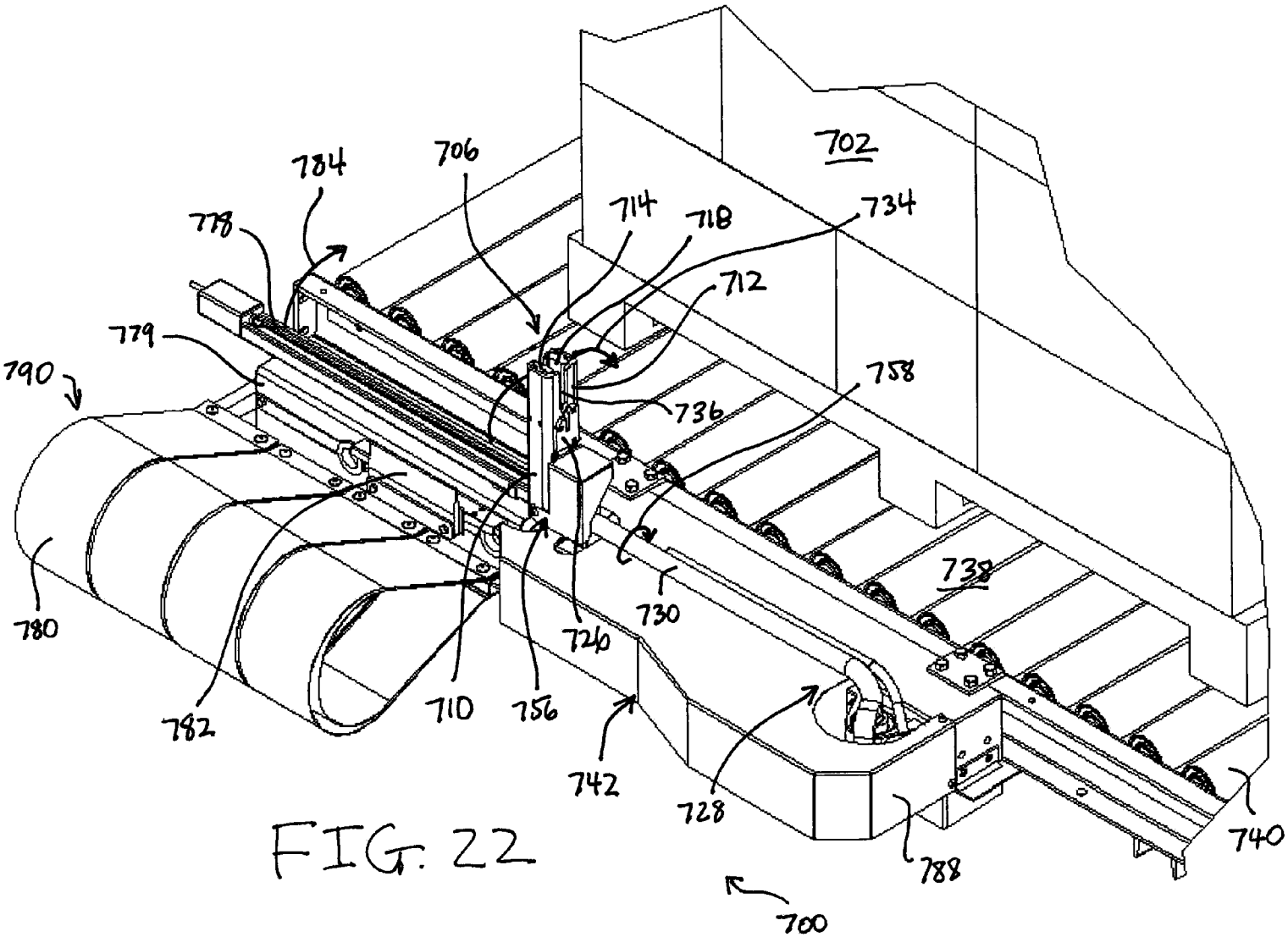
FIG. 22 is a perspective view of components of yet another wrapping apparatus, according to one aspect of the present disclosure.

The motion of insertion tool 182 is shown in FIGS. 9-11. Insertion tool 182 may include a flat plate, or alternatively, a vertically oriented cantilevered rod (see FIG. 21) having a fixed end and a free end. Insertion tool 182 may have a non-stick coating, and/or may be constructed from a non-stick material, such as Teflon™. This allows insertion tool 182 to be easily withdrawn from between bladders 114 and 118, leaving only packaging material 104 in between bladders 114 and 118. Bladders 114 and 118 may be fully pressurized during withdrawal of insertion tool 182, or at least one of bladders 114 and 118 may be partially depressurized to allow insertion tool 182 to be withdrawn from between bladders 114 and 118 more easily while maintaining a sufficient clamping force on packaging material 104. After insertion tool 182 has been withdrawn, the partially depressurized bladder may be repressurized to increase the clamping force on packaging material 104.

Insertion tool 182 may have a height of between approximately 5 inches to 8 inches to insert between approximately 5 inches to 8 inches of packaging material 104 into restricted jaw opening 136. The portion of packaging material 104 inserted into restricted jaw opening 136 by insertion tool 182 may be in the form of a fold or pleat including approximately 1.25 inches of packaging material 104 widthwise. It is contemplated that under different wrapping conditions, more or less film may be gathered or pleated when inserted into packaging material holder 106.

If insertion tool 182 is a flat plate, as shown in FIGS. 9-11, withdrawal may be accomplished by moving insertion tool 182 away from packaging material holder 106 in the direction opposite that of arrow 184. If insertion tool is a cantilevered rod, withdrawal may be accomplished by lifting the cantilevered rod vertically away from packaging material holder 106 after the cantilevered rod has passed horizontally through restricted jaw opening 136 to insert packaging material 104 between pressurized bladders 114 and 118.

Figure 12:
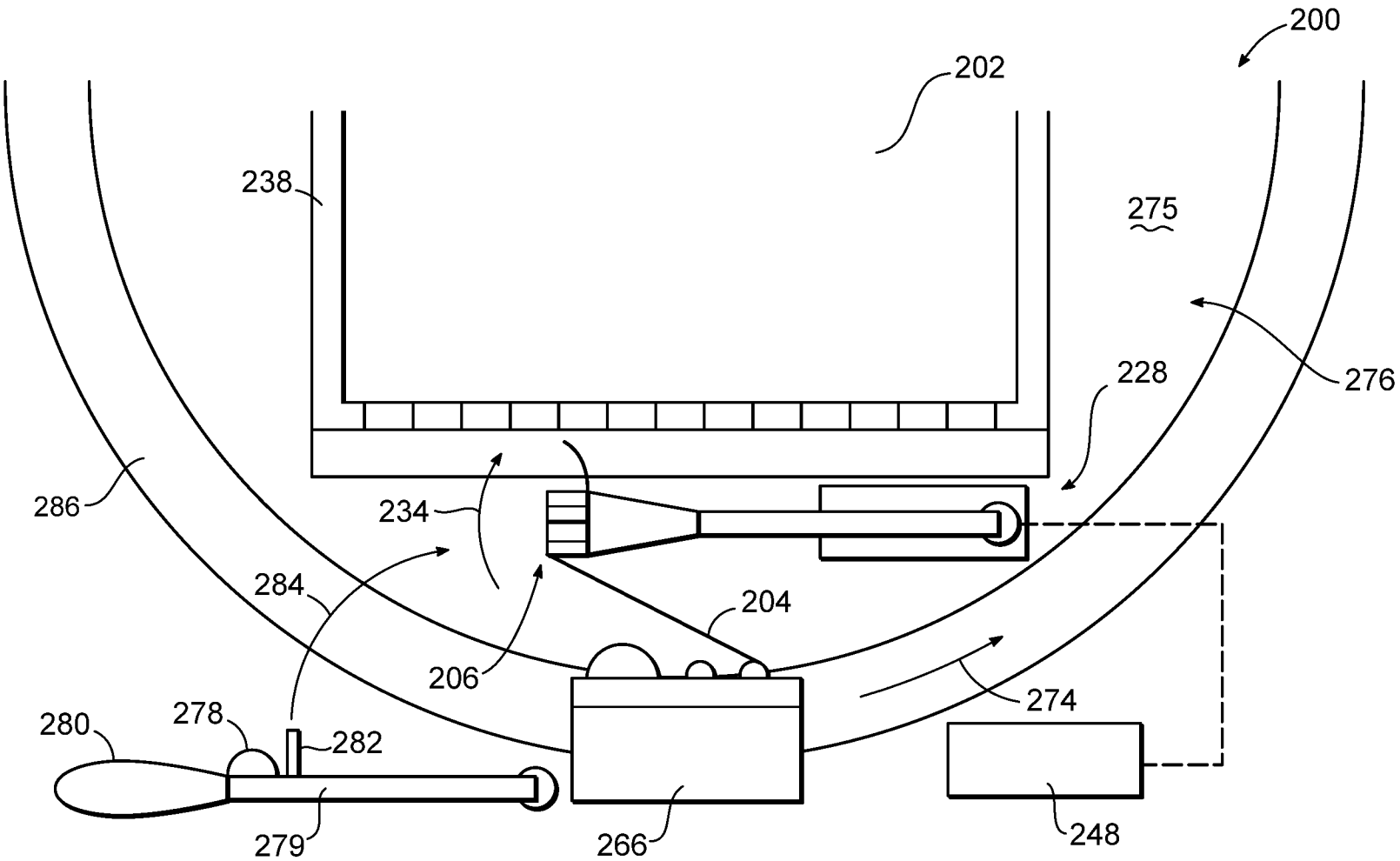
FIG. 12 is a top view of components of another wrapping apparatus, according to one aspect of the present disclosure.

According to another embodiment of the present disclosure, in which similar numerals designate components similar to those shown in FIGS. 1-11, an apparatus for wrapping a load 202 with packaging material 204 may include wrapping apparatus 200, shown in FIG. 12. Wrapping apparatus 200 may include a packaging material holder 206, a support arm assembly 228 configured to swing through an arc in and opposite to the direction of an arrow 234, a packaging material dispenser 266, a load support surface 238, a rotation assembly including a rotatable body 279 and a cutting assembly 278, a wipedown assembly 280, and/or an insertion tool 282, and a controller 248, similar to those described with respect to FIGS. 1-11. Rotatable body 279 and cutting assembly 278, wipedown assembly 280, and/or insertion tool 282, may travel along an arc in and opposite to the direction of an arrow 284. A relative rotation assembly 276 of apparatus 200 may include a rotatable turntable 275 that rotates in the direction of an arrow 274. Load 200 may rest on rotatable turntable 275, which serves as load support surface 238, and packaging material holder 206 and support arm assembly 228 may be mounted on the rotatable turntable, while packaging material dispenser 266 may be mounted on (or adjacent to) a non-rotating frame or base portion 286.

Figure 13:
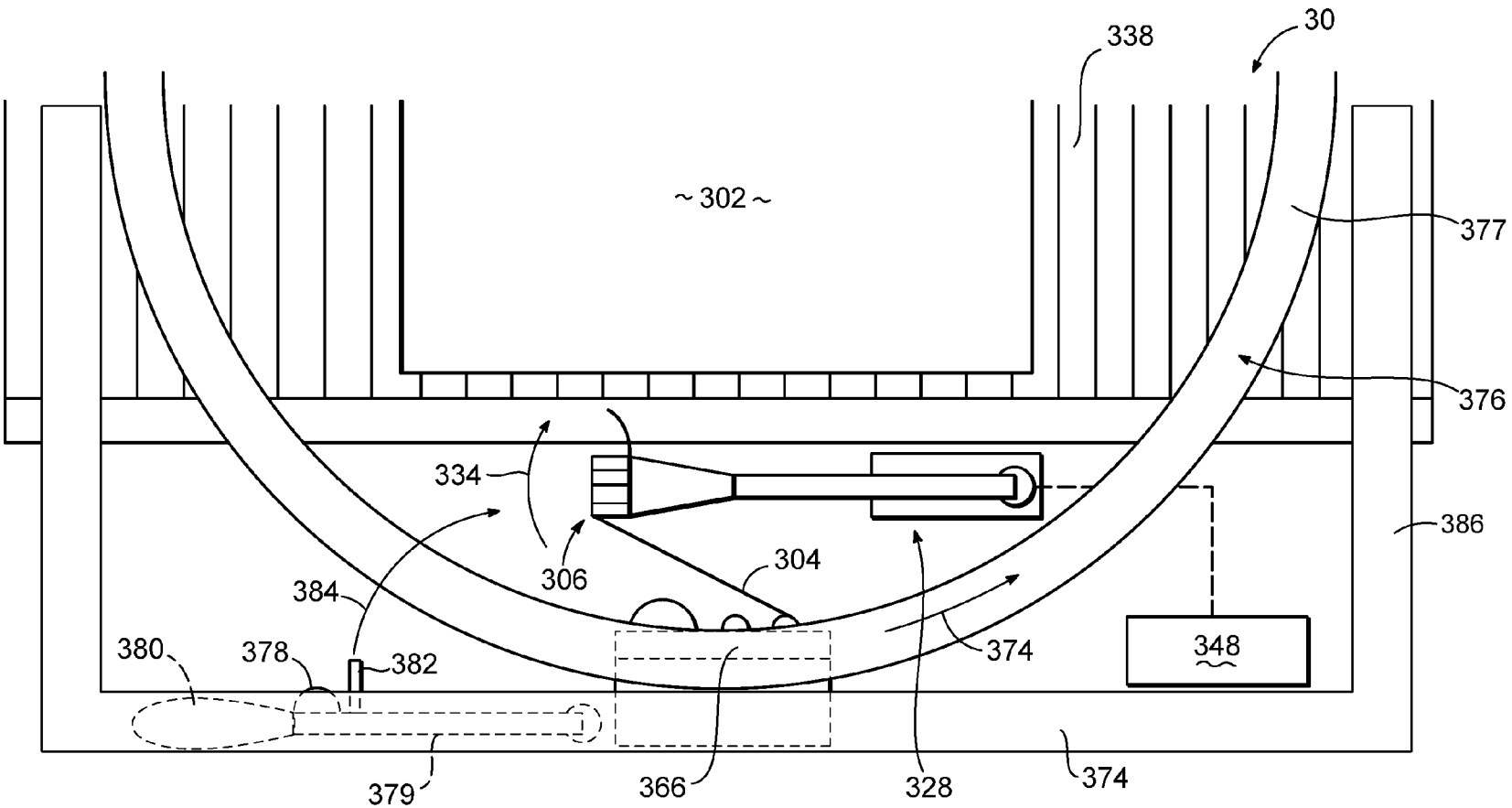
FIG. 13 is a top view of components of a different wrapping apparatus, according to one aspect of the present disclosure.

According to another embodiment of the present disclosure, in which similar numerals designate components similar to those shown in FIGS. 1-11, an apparatus for wrapping a load 302 with packaging material 304 may include wrapping apparatus 300, shown in FIG. 13. Wrapping apparatus 300 may include a packaging material holder 306, a support arm assembly 328 configured to swing through an arc in and opposite to the direction of an arrow 334, a packaging material dispenser 366, a load support surface 338, a rotation assembly including a rotatable body 379 and a cutting assembly 378, a wipedown assembly 380, and/or an insertion tool 382, and a controller 348, similar to those described with respect to FIGS. 1-11. Rotatable body 379 and cutting assembly 378, wipedown assembly 380, and/or insertion tool 382, may travel along an arc in and opposite to the direction of an arrow 384. A relative rotation assembly 376 of apparatus 300 may include a rotatable ring 377 supported by a vertically moveable frame 386. The rotatable ring 377 may rotate in the direction of arrow 374, and packaging material dispenser 366, being mounted on the rotatable ring, may rotate with it about load 302.

According to another embodiment of the present disclosure, in which similar numerals designate components similar to those shown in FIGS. 1-11, an apparatus for wrapping a load 402 on a support surface 438 with packaging material 404 may include wrapping apparatus 400, shown in FIGS. 14-18. Wrapping apparatus 400 may include a packaging material holder 406 having a first jaw 410, a second jaw 412, a first inflatable bladder 414 in a channel 416 of jaw 410, and a second inflatable bladder 418 in a channel 420 of jaw 412, similar to those described with respect to FIGS. 1-11. Wrapping apparatus 400 may also include a support arm assembly 428. Support arm assembly 428 may include a support arm 430, a fluid conduit 432, a hinged wrist portion 456 having a rod 460 and a spring 462, and an arm actuation assembly 442, similar to those described with respect to FIGS. 1-11. In this embodiment, support arm 430 may be linearly extendable in and opposite the direction of an arrow 434, rather than rotatable, over load support surface 438, to move packaging material holder 406 between the radially outward (unextended)

position and the radially inward (extended) position, and vice-versa. This movement may be driven by a hydraulic or pneumatic cylinder and piston (not shown) similar to those in FIGS. 1-11, but with support arm 430 being coupled to the piston for linear movement therewith. Additionally, packaging material holder 406 may rotate in the direction of arrow 458 with the assistance of wrist portion 456, about an axis perpendicular to the longitudinal axis of support arm 430.

Wrapping apparatus 400 may also include a packaging material dispenser 466, with components, similar to those described with respect to FIGS. 1-11. Wrapping apparatus 400 may further include a relative rotation assembly 476 in the form of a rotatable arm, similar to the one in FIGS. 1-11, configured to rotate in the direction of an arrow 474. Wrapping apparatus 400 may further include a cutting assembly 478, a wipedown assembly 480, and an insertion tool 482 similar to those described with respect to FIGS. 1-11. In this embodiment, cutting assembly 478, wipedown assembly 480, and insertion tool 482, may be configured to move substantially linearly toward load 402 in and opposite to the direction of an arrow 484 (i.e., the direction normal to a front surface of load 402). Alternatively, it is contemplated that cutting assembly 478, wipedown assembly 480, and/or insertion tool 482 may rotate, instead of moving linearly, wherein the rotation may swing cutting assembly 478, wipedown assembly 480, and/or insertion tool 482, along an arc that covers at least a portion of the path indicated by arrow 484. Cutting assembly 478, wipedown assembly 480, and/or insertion tool 482 may be mounted on a body 479 configured to travel linearly in and opposite the direction of arrow 484. Thus, body 479 and cutting assembly 478, wipedown assembly 480, and/or insertion tool 482 may form a linear bearing assembly.

Figure 17:
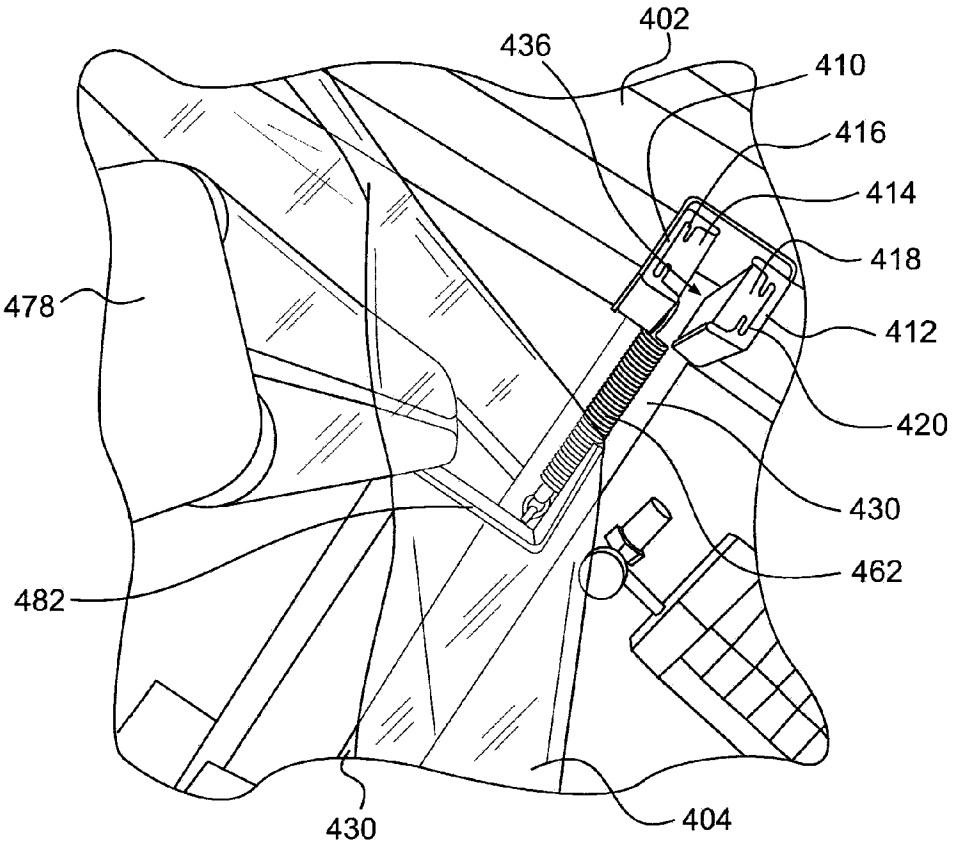
Figure 18:
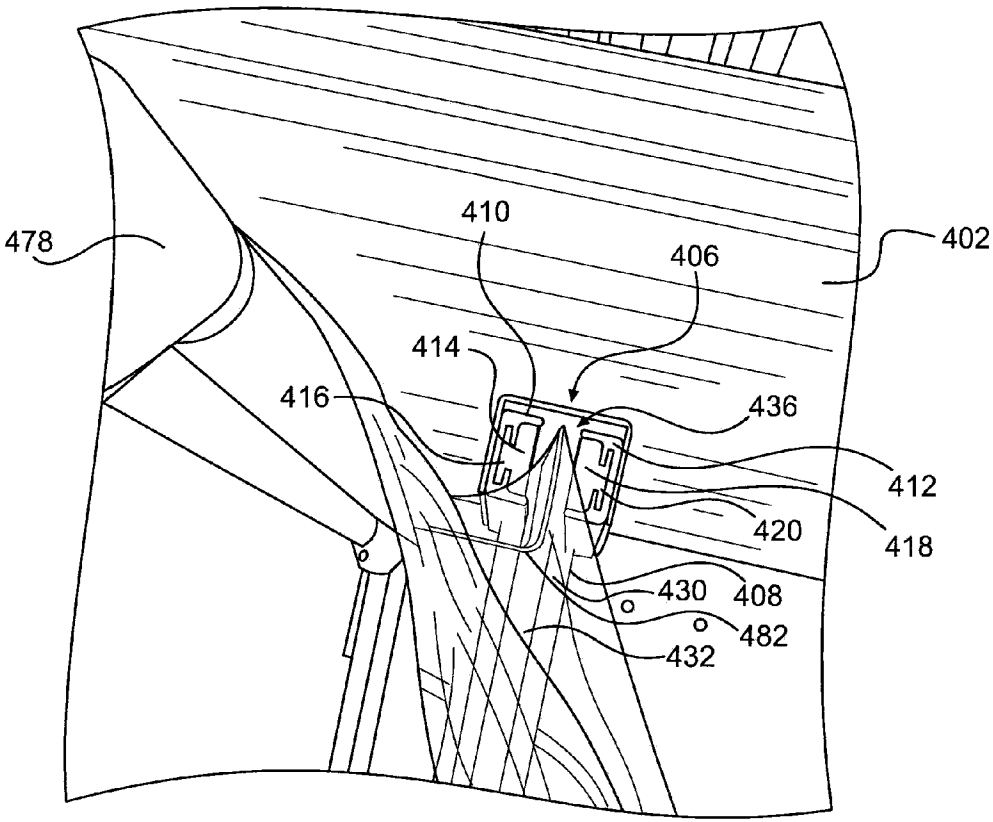
Figure 19:
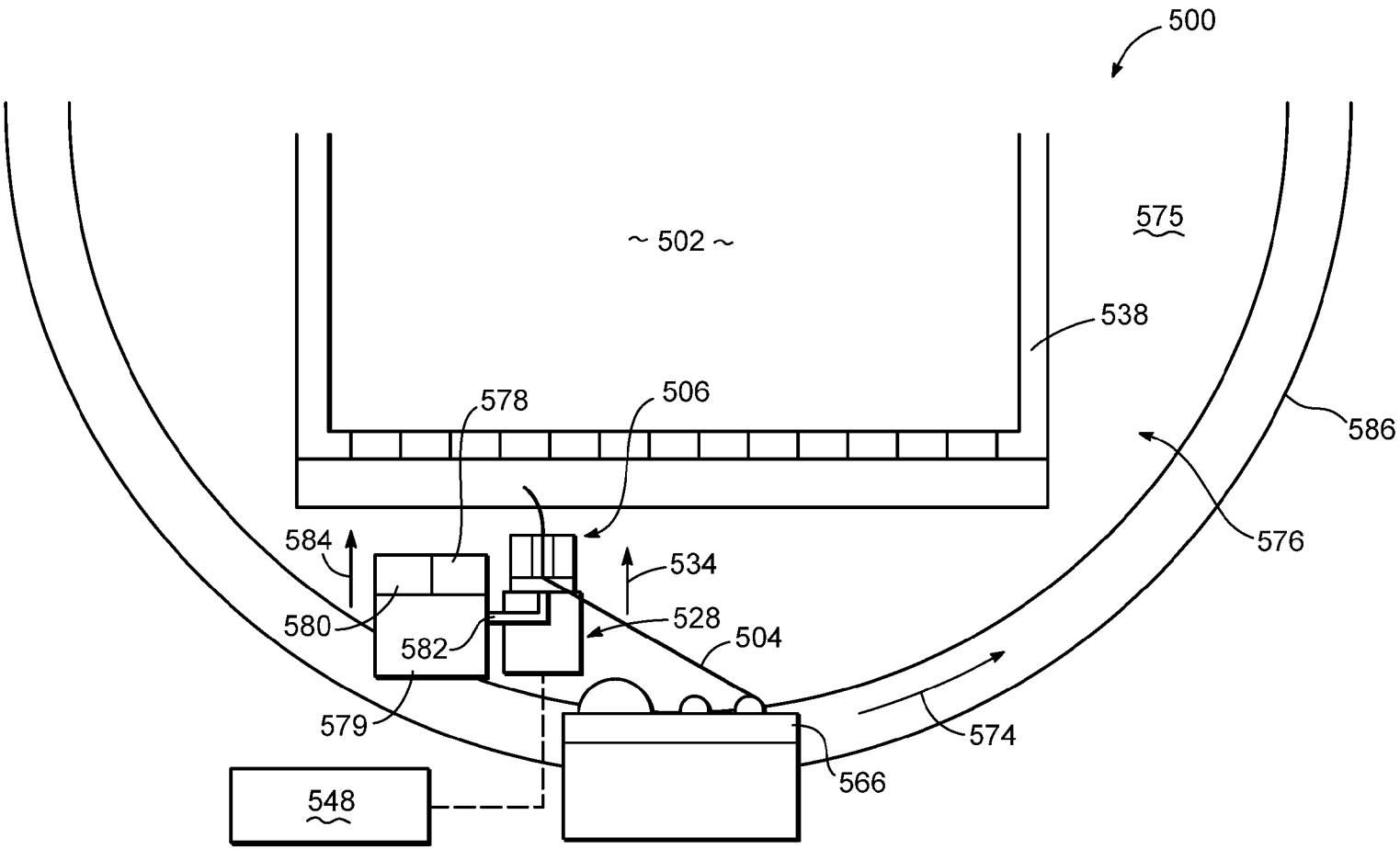
FIG. 19 is a top view of components of another wrapping apparatus, according to one aspect of the present disclosure.

According to another embodiment of the present disclosure, in which similar numerals designate components similar to those shown in FIGS. 14-18, an apparatus for wrapping a load 502 with packaging material 504 may include wrapping apparatus 500, shown in FIG. 19. Wrapping apparatus 500 may include a packaging material holder 506, a support arm assembly 528 configured to move along a linear path in and opposite to the direction of an arrow 534, a packaging material dispenser 566, a load support surface 538, a linear bearing assembly including a body 579 and a cutting assembly 578, a wipedown assembly 580, and/or an insertion tool 582, and a controller 548, similar to those described with respect to FIGS. 14-18. Body 579 and cutting assembly 578, wipedown assembly 580, and/or insertion tool 582, may travel along a linear path in and opposite to the direction of an arrow 584. A relative rotation assembly 576 of apparatus 500 may include a rotatable turntable that rotates in the direction of an arrow 574. Load 502 may rest on the rotatable turntable, and packaging material holder 506 and support arm assembly 528 may be mounted on the rotatable turntable, while packaging material dispenser 566 may be mounted on a non-rotating frame or base portion 586.

Figure 20:
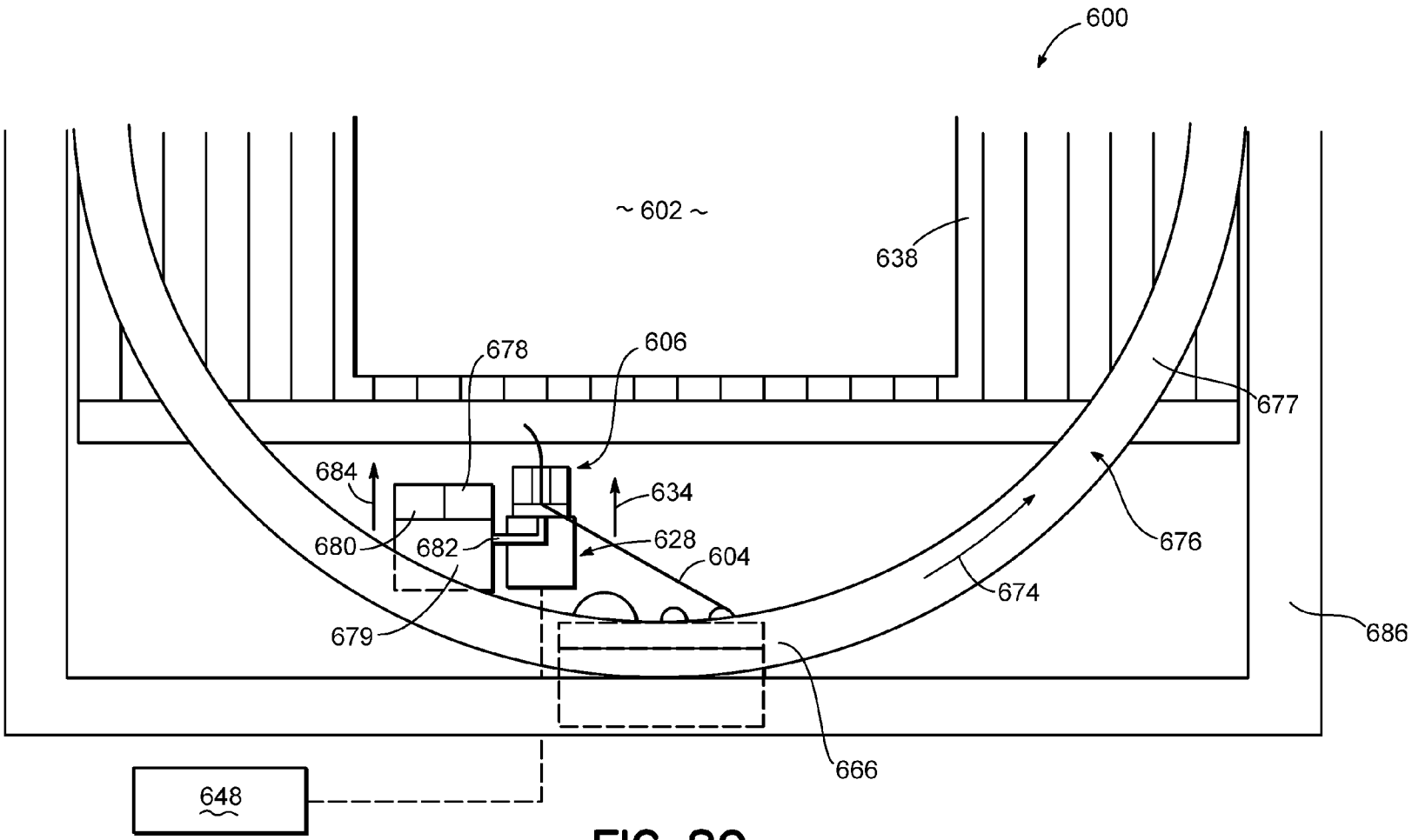
FIG. 20 is a top view of components of a different wrapping apparatus, according to one aspect of the present disclosure.

According to another embodiment of the present disclosure, in which similar numerals designate components similar to those shown in FIGS. 14-18, an apparatus for wrapping a load 602 with packaging material 604 may include wrapping apparatus 600, shown in FIG. 20. Wrapping apparatus 600 may include a packaging material holder 606, a support arm assembly 628 configured to move along a linear path in and opposite to the direction of an arrow 634, a packaging material dispenser 666, a load support surface 638, a linear bearing assembly including a body 679 and a cutting assembly 678, a wipedown assembly 680, and/or an insertion tool 682, and a controller 648, similar to those described with respect to FIGS. 14-18. Body 679 and cutting assembly 678, wipedown assembly 680, and/or insertion tool 682, may travel along a linear path in and opposite to the direction of an arrow 684. A relative rotation assembly 676 of apparatus 600 may include a rotatable ring supported by a vertically moveable frame 686. The rotatable ring may rotate in the direction of arrow 674, and packaging material dispenser 666, being mounted on the rotatable ring, may rotate with it about load 602.

According to another embodiment of the present disclosure, in which similar numerals designate components similar to those shown in FIGS. 1-20, an apparatus 700 for wrapping a load 702 on a support surface 738 with packaging material 704 is shown in FIGS. 22-29. Wrapping apparatus 700 may include a packaging material holder 706 having a first jaw 710, a second jaw 712, a first inflatable bladder 714 in a channel 716 of first jaw 710, a second inflatable bladder 718 in a channel 720 in second jaw 712, and packaging material cutter 726, similar to those described with respect to FIGS. 1-20. Wrapping apparatus 700 may also include a support arm assembly 728. Support arm assembly 728 may include a support arm 730, a fluid conduit 732, a hinged wrist portion 756 having a rod (not shown) and a spring (not shown), and an arm actuation assembly 742, similar to those described with respect to FIGS. 1-13. Arm actuation assembly 742 may be contained in a housing 788.

Support arm 730 may be configured to swing in and opposite to the direction indicated by an arrow 734, over load support surface 738, to move packaging material holder 706 between a radially outward position (shown in FIGS. 22 and 24-29) away from load 702 and a radially inward position (shown in FIG. 23) adjacent load 702, and vice-versa. This movement may be driven by a hydraulic or pneumatic cylinder and piston (not shown) similar to those in FIGS. 1-13. Additionally, packaging material holder 706 may rotate about an axis perpendicular to the longitudinal axis of support arm 730 (as indicated by arrow 758) with the assistance of wrist portion 756.

Wrapping apparatus 700 may also include a packaging material dispenser (not shown), with components, similar to those described with respect to FIGS. 1-20. Wrapping apparatus 700 may further include a relative rotation assembly (not shown) in the form of a rotatable arm, rotatable turntable, and/or rotatable ring, similar to those shown in FIGS. 1-20, configured to provide relative rotation between load 702 and the packaging material dispenser. Wrapping apparatus 700 may further include a rotation assembly 790 including a rotatable body 779 and a cutting assembly 778, a wipedown assembly 780, and/or an insertion tool 782. In this embodiment, rotatable body 779 and cutting assembly 778, wipedown assembly 780, and/or insertion tool 782, may be configured to rotate between a substantially horizontal position (shown in FIGS. 22-24 and 29) to a substantially vertical position (shown in FIGS. 25-28). In addition to moving between the substantially horizontal and the substantially vertical positions, wipedown assembly 780 may also be configured to rotate about its longitudinal axis as illustrated in FIGS. 25-28. Rotation of rotatable body 779 and cutting assembly 778, wipedown assembly 780, and/or insertion tool 782 may be achieved through the use of any suitable actuation means, including, for example, mechanical, pneumatic, hydraulic, and/or electrical actuators. Cutting assembly 778 may include a hot wire, blade, or any other suitable cutting means.

It is contemplated that the rotation assembly 790, including rotatable body 779 and cutting assembly 778, wipedown assembly 780, and/or insertion tool 782 may be at least partially, or completely, within a wrapping zone of wrapping apparatus 700. The wrapping zone of a wrapping apparatus may include an area circumscribed by a packaging material dispenser as the packaging material dispenser rotates relative to a load. A portion of the wrapping zone of wrapping apparatus 700 is shown in dotted line in FIG. 23. It should be understood that the wrapping zone may be larger or smaller depending on the size of load 702 being wrapped, and/or other wrapping conditions. For example, the wrapping zone of wrapping apparatus 100 may include the area circumscribed by packaging material dispenser 166 as it rotates in the direction of arrow 174, as shown in dotted line in FIG. 1. With wrapping apparatus 100, the rotation assembly formed by rotatable body 179 and cutting assembly 178, wipedown assembly 180, and/or insertion tool 182, may be positioned outside of the wrapping zone of wrapping apparatus 100 when in the position shown in FIG. 1. The rotation assembly 790 may rotate into the wrapping zone of wrapping apparatus 100 by moving in the direction of arrow 184. At least a portion of the rotation assembly 790 of wrapping apparatus 700 may remain in the wrapping zone of wrapping apparatus 700, rather than moving into and out of the wrapping zone. This arrangement allows wrapping apparatus 700 to have a smaller footprint than would otherwise be possible. For example, in FIGS. 22-24 and 29, rotatable body 779 may occupy a substantially horizontal position so that rotatable body 779 and cutting assembly 778, wipedown assembly 780, and insertion tool 782 are positioned below a pass height of packaging material 704 as it is wrapped around load 702. The clearance helps to ensure that rotatable body 779 and cutting assembly 778, wipedown assembly 780, and insertion tool 782 will not interfere with wrapping of load 702, even though they are in the wrapping zone. Near the end of the wrapping cycle, rotatable body 779 may rotate into a substantially vertical position, as shown in FIGS. 25-28, so that cutting assembly 778, wipedown assembly 780, and insertion tool 782 may engage packaging material 704 to cut packaging material 704, wipedown a portion of packaging material 704 onto wrapped load 702, and insert another portion of packaging material 704 into packaging material holder 706. Afterwards, rotatable body 719 may rotate back to the horizontal position so the next load can be wrapped.

A method for wrapping a load according to the present disclosure will now be described. Load 102 may be conveyed onto load support surface 138. Packaging material holder 106 may be in the distant position (e.g., away from load 102), and may be held there by piston 146 acting on leg portion 150 of support arm assembly 128 as piston 146 is in its extended position, as shown in FIGS. 1 and 4. Leading end portion 108 of a sheet of packaging material 104 may be positioned between and engaged by first inflatable bladder 114 and second inflatable bladder 118, and thus, may be clamped in restricted jaw opening 136 of packaging material holder 106, as shown in FIG. 1. If leading end portion 108 is not clamped, a user may insert leading end portion 108 into restricted jaw opening 136 for clamping, as shown in FIG. 6.

Relative rotation assembly 176 may begin to rotate packaging material dispenser 166 in the direction of arrow 174 about load 102. As relative rotation assembly 176 begins to rotate packaging material dispenser 166, piston 146 may be retracted, allowing spring 154 and/or leading end portion 108 to exert a force upon packaging material holder 106. That force may cause rotation of packaging material holder 106 and support arm 130 above load support surface 138 in the direction of arrow 134, toward the "near" position shown in FIG. 7. In one embodiment, packaging material holder 106 may continue to move toward load 102 until it touches a side of load 102, whereupon its radially inward movement may stop.

As packaging material holder 106 reaches its near position, relative rotation assembly may continue to rotate packaging material dispenser 166 about load 102. As packaging material dispenser 166 dispenses packaging material 104 during this rotation, it may overwrap packaging material holder 106, positioned adjacent the side of load 102, with a layer or layers of packaging material (see FIG. 7). After load 102 is wrapped, and the rotatable arm and packaging material dispenser 166 have returned to a "home" position, shown in FIG. 1, the overwrapped packaging material holder 106 may release leading end portion 108 of packaging material 104. The release may be achieved by depressurizing one or both of first inflatable bladder 114 and second inflatable bladder 118. Piston 146 may then be actuated to press leg portion 150 to rotate support arm 130, moving packaging material holder 106 to the distant position. This may force a side of packaging material holder 106 against the overwrapped packaging material 104, which may in turn cause packaging material holder 106 to rotate about wrist portion 156 in the direction of arrow 158 toward the rotated position, as shown in FIG. 8. This may free packaging material holder 106 for movement out from between load 102 and the overwrapped packaging material 104. Guard 164 may assist by guiding the overwrapped packaging material 104 off of packaging material holder 106 and support arm 130. If wrist portion 156 is biased by spring 162, then, once free of the overwrapped packaging material 104, packaging material holder 106 may return to the upright position.

Once packaging material holder 106 has reached the distant position, cutting assembly 178, wipedown assembly 180, and insertion tool 182, may be actuated. Cutting assembly 178 may sever packaging material 104 that extends between load 102 and packaging material dispenser 166. Wipedown assembly 180 may press tail end portion 107 of packaging material 104 onto the layers of packaging material 104 wrapped about load 102. As shown in FIGS. 9-11, insertion tool 182 may force new leading end portion 108 of packaging material 104 into restricted jaw opening 136 of packaging material holder 106 while one or both of inflatable bladders 114 and 118 are depressurized, at which time controller 148 may initiate pressurizing first inflatable bladder 114 and second inflatable bladder 118 such that new leading end portion 108 of packaging material 104 may be clamped by packaging material holder 106. Alternatively, insertion tool 182 may insert packaging material 104 into restricted jaw opening while one or both of inflatable bladders 114 and 118 are at least partially pressurized, or fully pressurized. Insertion tool 182 may then be withdrawn from between the pressurized first inflatable bladder 114 and second inflatable bladder 118, leaving packaging material 104 clamped, as shown in FIG. 1. Now wrapped, load 102 may be conveyed out of the wrapping area. With a new leading end portion 108 clamped by packaging material holder 106, apparatus 100 may wrap the next load by repeating the steps discussed above.

With the embodiment of FIG. 12, packaging material holder 206 may hold leading end portion 208 of packaging material 204 as relative rotation assembly 276 begins to rotate load 202 and packaging material holder 206 relative to packaging material dispenser 266 in the direction of arrow 274. The remainder of the process may include steps similar to those performed and described with respect to FIGS. 1-11.

With the embodiment of FIG. 13, relative rotation assembly 376 may provide relative rotation between packaging material dispenser 366 and load 302 by the rotation of the rotatable ring in the direction of arrow 374. Aside from this, the process for wrapping load 302 in this embodiment may be similar to the method described with respect to FIGS. 1-11.

Figure 14:
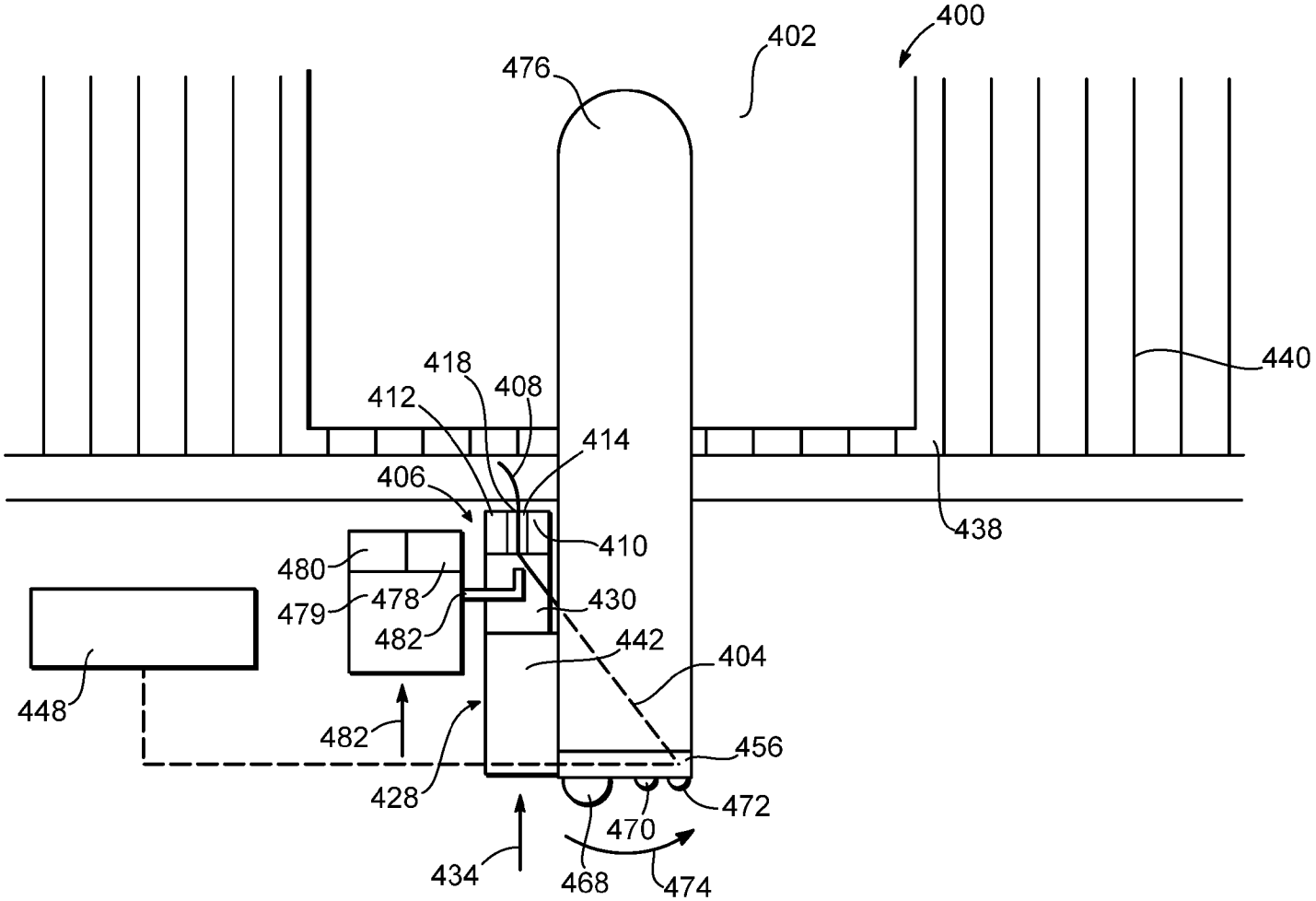
FIG. 14 is a top view of components of yet another wrapping apparatus, according to one aspect of the present disclosure.
Figure 15:
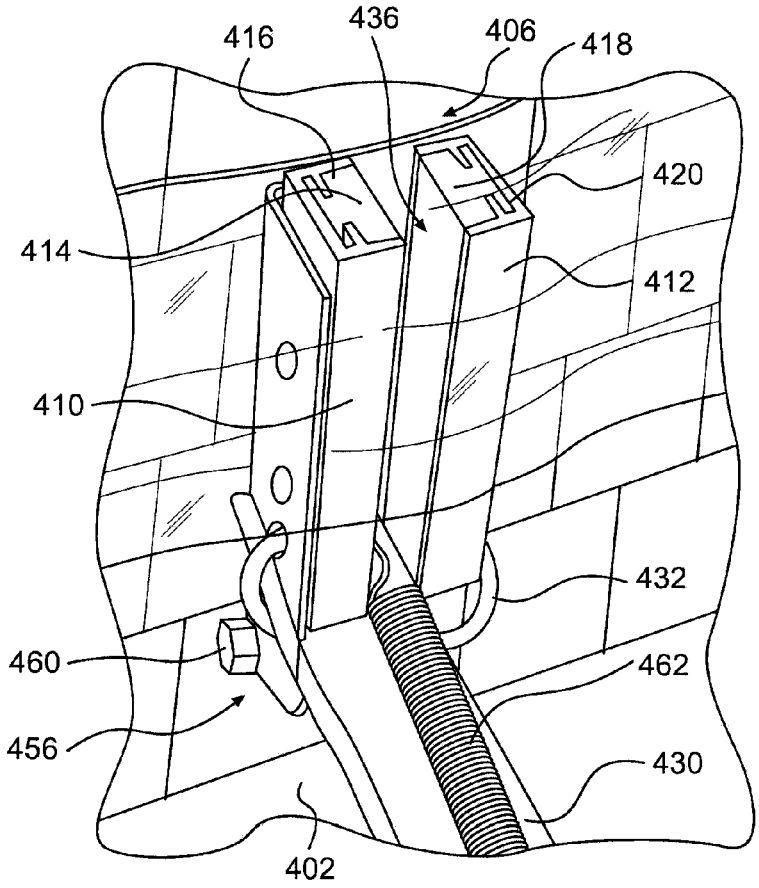
FIGS. 15-18 are sequential perspective views of the packaging material holder of the wrapping apparatus of FIG. 14 in use, according to one aspect of the present disclosure.

Another method for wrapping a load according to the present disclosure will now be described. Load 402 may be conveyed onto load support surface 438. Packaging material holder 406 may be in the distant position (e.g., away from load 402). Leading end portion 408 of a sheet of packaging material 404 may be positioned between and engaged by first inflatable bladder 414 and second inflatable bladder 418, and thus, may be clamped in restricted jaw opening 436 of packaging material holder 406, as shown in FIG. 14. If leading end portion 408 is not clamped, a user may insert leading end portion 408 into restricted jaw opening 436 for clamping, similar to the step shown in FIG. 6.

Relative rotation assembly 476 may begin to rotate packaging material dispenser 466 in the direction of arrow 474 about load 402. As relative rotation assembly 476 begins to rotate packaging material dispenser 466, packaging material holder 406 and support arm 430 may be moved above load support surface 438 toward the direction indicated by arrow 434, toward the "near" position shown in FIG. 15. In one embodiment, packaging material holder 406 may continue to move toward load 402 until it touches a side of load 402, whereupon its radially inward movement may stop.

Figure 16:
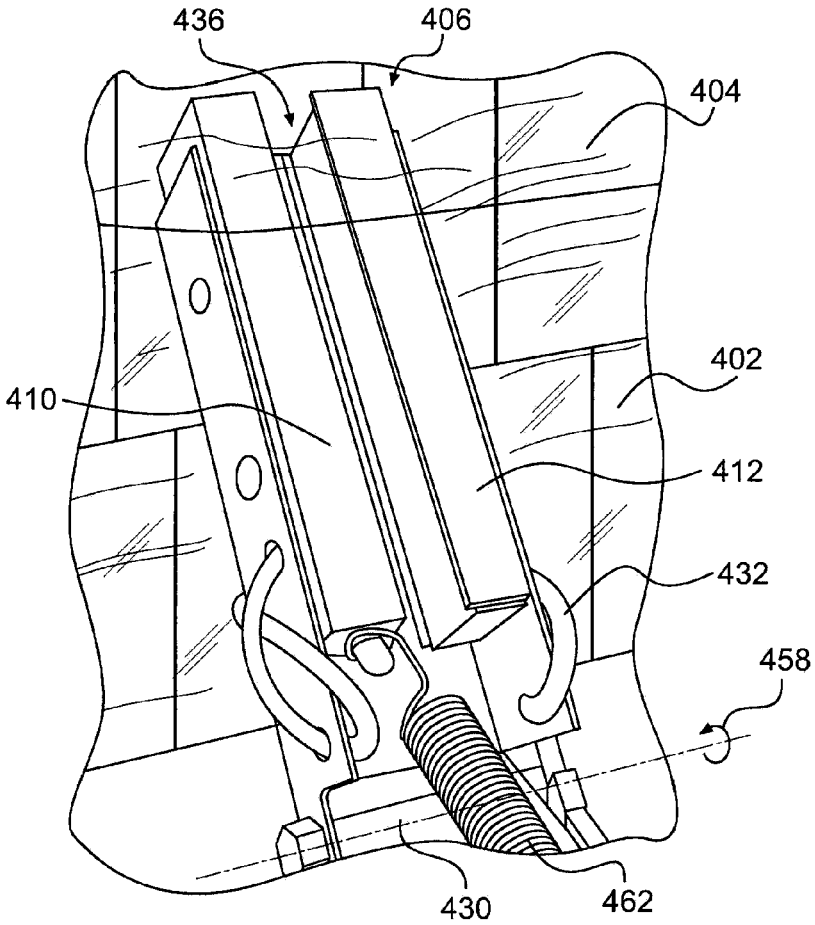

As packaging material holder 406 reaches its near position, relative rotation assembly may continue to rotate packaging material dispenser 466 about load 402. As packaging material dispenser 466 dispenses packaging material 404 during this rotation, it may overwrap packaging material holder 406, positioned adjacent the side of load 402, with a layer or layers of packaging material (see FIG. 15). The overwrapped packaging material holder 406 may release leading end portion 408 of packaging material 404. The release may be achieved by depressurizing one or both of first inflatable bladder 414 and second inflatable bladder 418. Support arm 130 may be moved in the direction opposite that indicated by arrow 434, moving packaging material holder 406 to the distant position. This may force a side of packaging material holder 406 against the overwrapped packaging material 404, which may in turn cause packaging material holder 406 to rotate about wrist portion 456 in the direction of arrow 458 toward the rotated position, as shown in FIG. 16. This may free packaging material holder 406 for movement out from between load 402 and the overwrapped packaging material 404. Once free of the overwrapped packaging material 404, packaging material holder 406 may return to the upright position.

Packaging material holder 406 may travel back to the "near" position adjacent to or abutting load 402 in the direction indicated by arrow 434 during the final rotation of packaging material dispenser 466 relative to load 402. This is shown in FIGS. 17 and 18. This movement is in preparation for cutting, wipedown, and clamping of packaging material 404. Once packaging material holder 406 has reached the "near" position, cutting assembly 478, wipedown assembly 480, and insertion tool 482, may be actuated. Cutting assembly 478 may sever packaging material 404 that extends between load 402 and packaging material dispenser 466. Wipedown assembly 480 may press a tail end portion of packaging material 404 (attached to wrapped load 402) onto the layers of packaging material 404 wrapped about load 402. As shown in FIGS. 17 and 18, insertion tool 482 may force new leading end portion 408 of packaging material 404 into restricted jaw opening 436 of packaging material holder 406 while one or both of inflatable bladders 414 and 418 are depressurized, at which time a controller 448 may initiate pressurizing first inflatable bladder 414 and second inflatable bladder 418 such that new leading end portion 408 of packaging material 404 may be clamped by packaging material holder 406. Alternatively, insertion tool 482 may insert packaging material 404 into restricted jaw opening 436 while one or both of inflatable bladders 414 and 418 are at least partially pressurized, or fully pressurized. Insertion tool 482 may then be withdrawn from between first inflatable bladder 414 and second inflatable bladder 418, leaving packaging material 404 clamped between them. Bladders 414 and 418 may be fully pressurized during withdrawal of insertion tool 482. Alternatively, to assist with the withdrawal of insertion tool 482, at least one of bladders 414 and 418 may be partially depressurized, but still pressurized enough to exert a clamping force on packaging material 404. After insertion tool 482 has been withdrawn, the partially depressurized bladder may be repressurized to increase the clamping force. Support arm 130 may retract, moving packaging material holder 406 away from wrapped load 402. Wrapped, load 402 may be conveyed out of the wrapping area. With a new leading end portion 408 clamped by packaging material holder 406, apparatus 400 may wrap the next load by repeating the steps discussed above.

Since packaging material holder 406 is in the near position during cutting, wipedown, and clamping, the length of a tail end portion of packaging material 404 may be minimized. Additionally, as the distance between packaging material holder 406 and load 402 becomes larger, the stress on the layers of packaging material 404 used to overwrap packaging material holder 406 increases. If the stress is too high, packaging material 404 may tear, or the containment force exerted on load by packaging material 404 may decrease. However, if, as in this embodiment, the distance between packaging material holder 406 and load 402 is made smaller, such as when packaging material holder 406 comes near or touches the side of load 402, the stress on the layers of packaging material 404 overwrapping packaging material holder 406 may be reduced.

With the embodiment of FIG. 19, packaging material holder 506 may hold leading end portion 508 of packaging material 504 as relative rotation assembly 576 begins to rotate load 502 and packaging material holder 506 in the direction of arrow 534. The remainder of the process may include steps similar to those performed and described with respect to FIGS. 14-18.

With the embodiment of FIG. 20, relative rotation may be provided by relative rotation assembly 676. Aside from this, the process for wrapping load 602 in this embodiment may be similar to the method described with respect to FIGS. 14-18.

Figure 23:
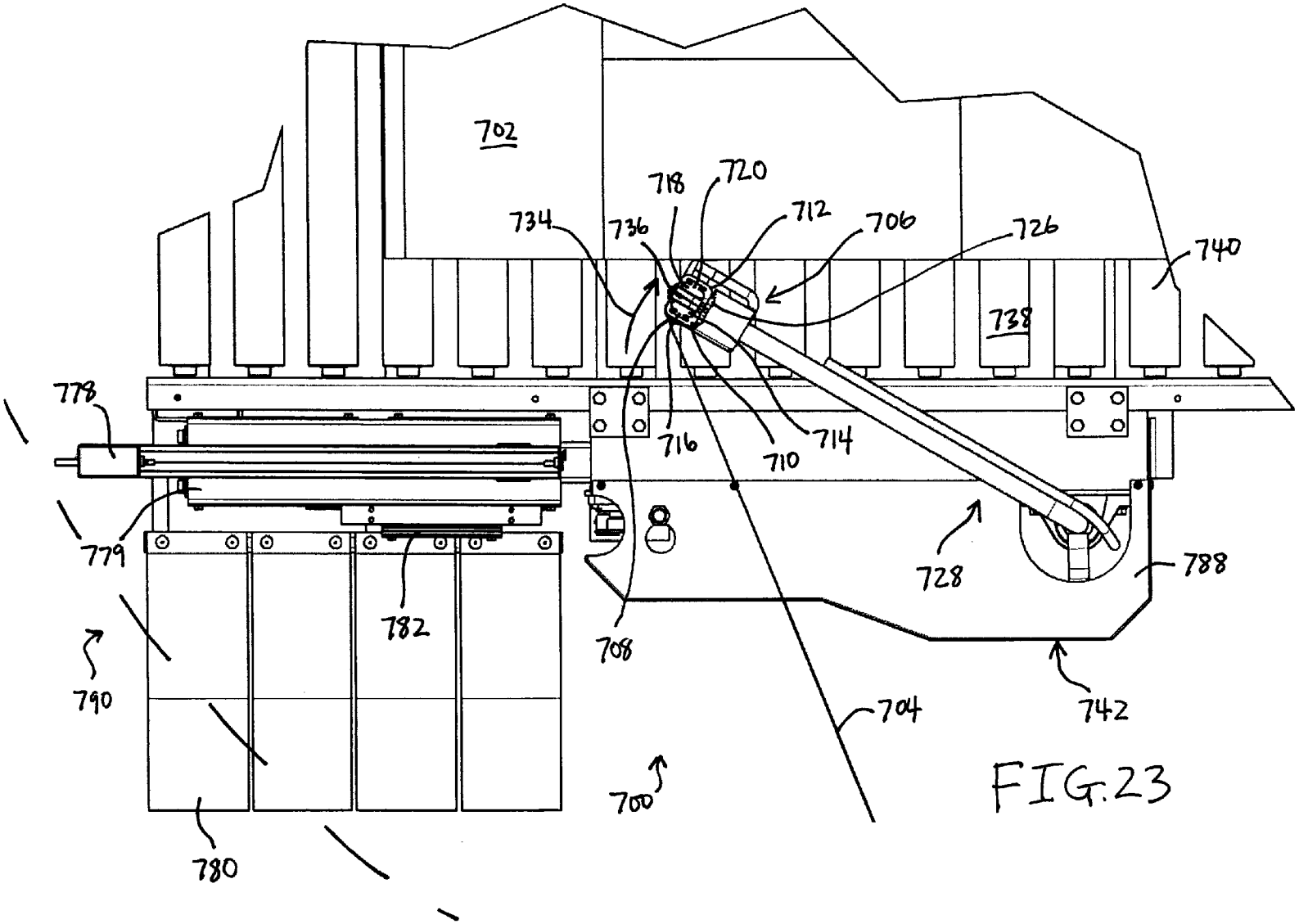
FIG. 23 is a top view of components of the wrapping apparatus of FIG. 22 in use, according to one aspect of the present disclosure.
Figure 29:
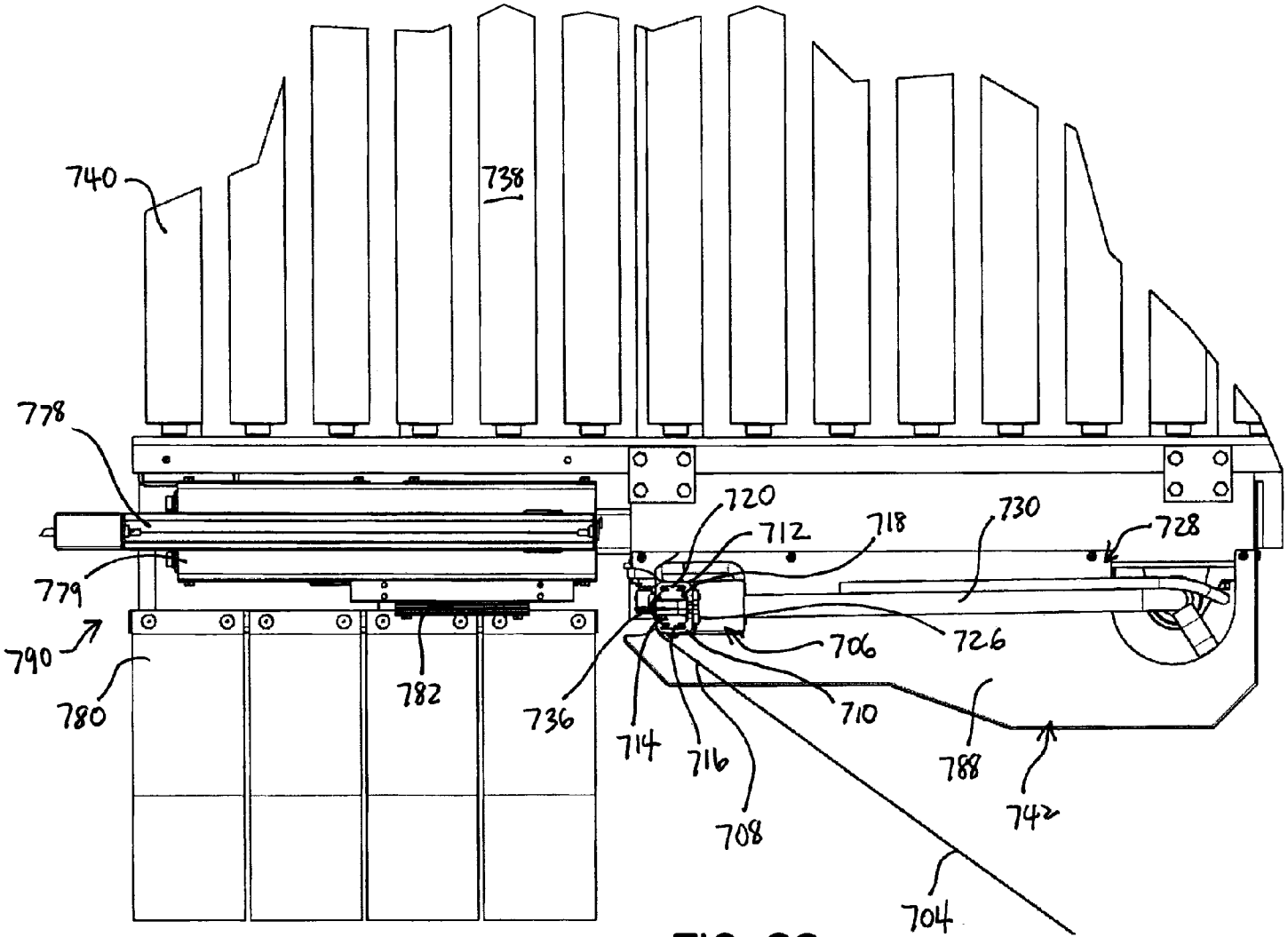
FIG. 29 is another top view of components of the wrapping apparatus of FIG. 22 in use, according to one aspect of the present disclosure.

A method for wrapping load 702 with the embodiment shown in FIGS. 22-26 will now be described. Load 702 may be conveyed onto load support surface 738. Packaging material holder 706 may be held in the distant position by actuation assembly 742, as shown in FIG. 29. A leading end portion 708 of a sheet of packaging material 704 may be engaged by first inflatable bladder 714 and second inflatable bladder 718, and thus, may be clamped in restricted jaw opening 736 of packaging material holder 706. Packaging material 704 may initially extend from packaging material holder 706 toward the packaging material dispenser. As shown in FIG. 23, the packaging material dispenser may be positioned radially outwardly of at least a portion of a rotation assembly 790 formed by rotatable body 779 and cutting assembly 778, wipedown assembly 780, and/or insertion tool 782, and thus, at least a portion of rotation assembly 790 remains in the wrapping zone of wrapping apparatus 700 in FIGS. 22-29 during wrapping of load 702.

A relative rotation assembly (not shown) may begin to rotate a packaging material dispenser (not shown) in the direction of arrow 774 about load 702. As the relative rotation assembly begins to rotate the packaging material dispenser, actuation assembly 742 may rotate packaging material holder 706 and support arm 730 above load support surface 738 in the direction of arrow 734, toward the near position as shown in FIG. 23.

Figure 24:
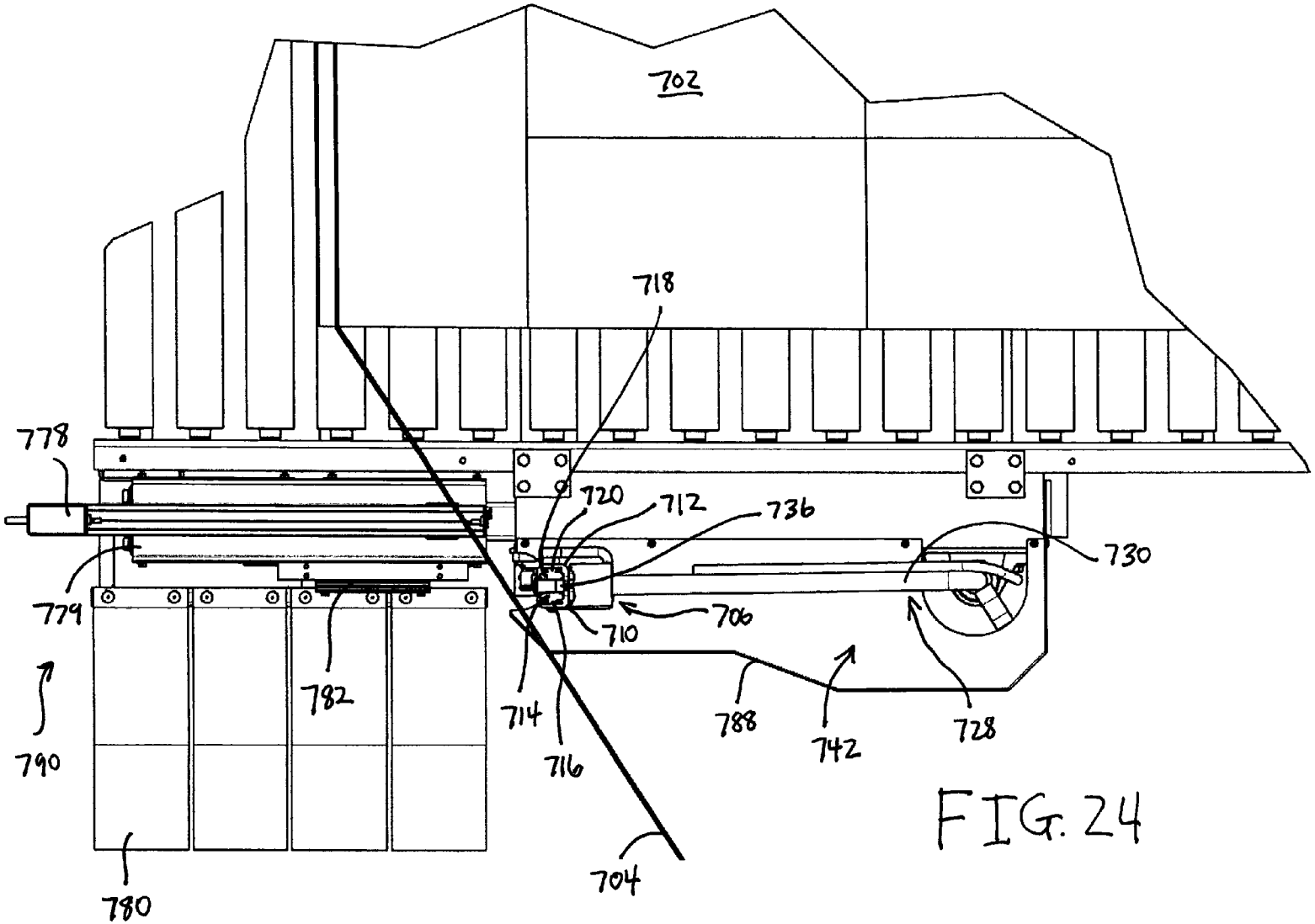
FIG. 24 is another top view of components of the wrapping apparatus of FIG. 22 in use, according to one aspect of the present disclosure.

As packaging material holder 706 reaches its near position, the relative rotation assembly may continue to rotate the packaging material dispenser about load 702. As packaging material dispenser dispenses packaging material 704 during this rotation, it may overwrap packaging material holder 706 with a layer or layers of packaging material, similar to what is shown in FIGS. 7 and 8. After load 702 is wrapped, and the relative rotation assembly and the packaging material dispenser have returned to a "home" position, the overwrapped packaging material holder 706 may release leading end portion 708 of packaging material 704. The release may be achieved by depressurizing at least one of first inflatable bladder 714 and second inflatable bladder 718. Actuation assembly 742 may rotate support arm 730, bringing packaging material holder 706 to the distant position, in a manner similar to that which is described with respect to wrapping apparatus 100. This may force a side of packaging material holder 706 against the overwrapped packaging material 704, which may in turn cause packaging material holder 706 to rotate about wrist portion 756 in the direction of arrow 758 toward the rotated position, similar to the movement shown in FIG. 8. This may free packaging material holder 706 for movement out from between load 702 and the overwrapped packaging material 704. Once free of the overwrapped packaging material 704, packaging material holder 706 may return to the upright position, as shown in FIG. 24.

Figure 25:
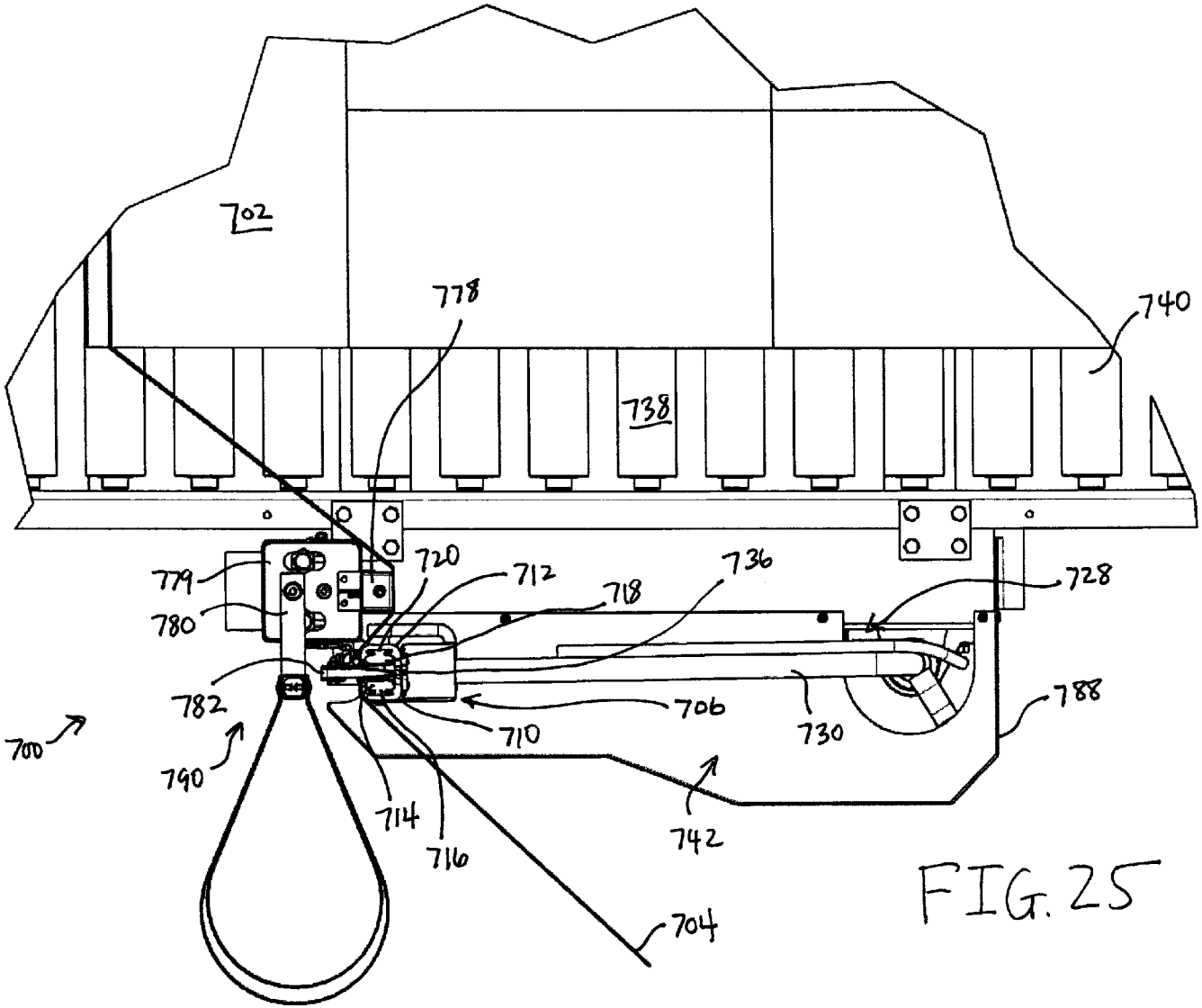
FIG. 25 is another top view of components of the wrapping apparatus of FIG. 22 in use, according to one aspect of the present disclosure.
Figure 26:
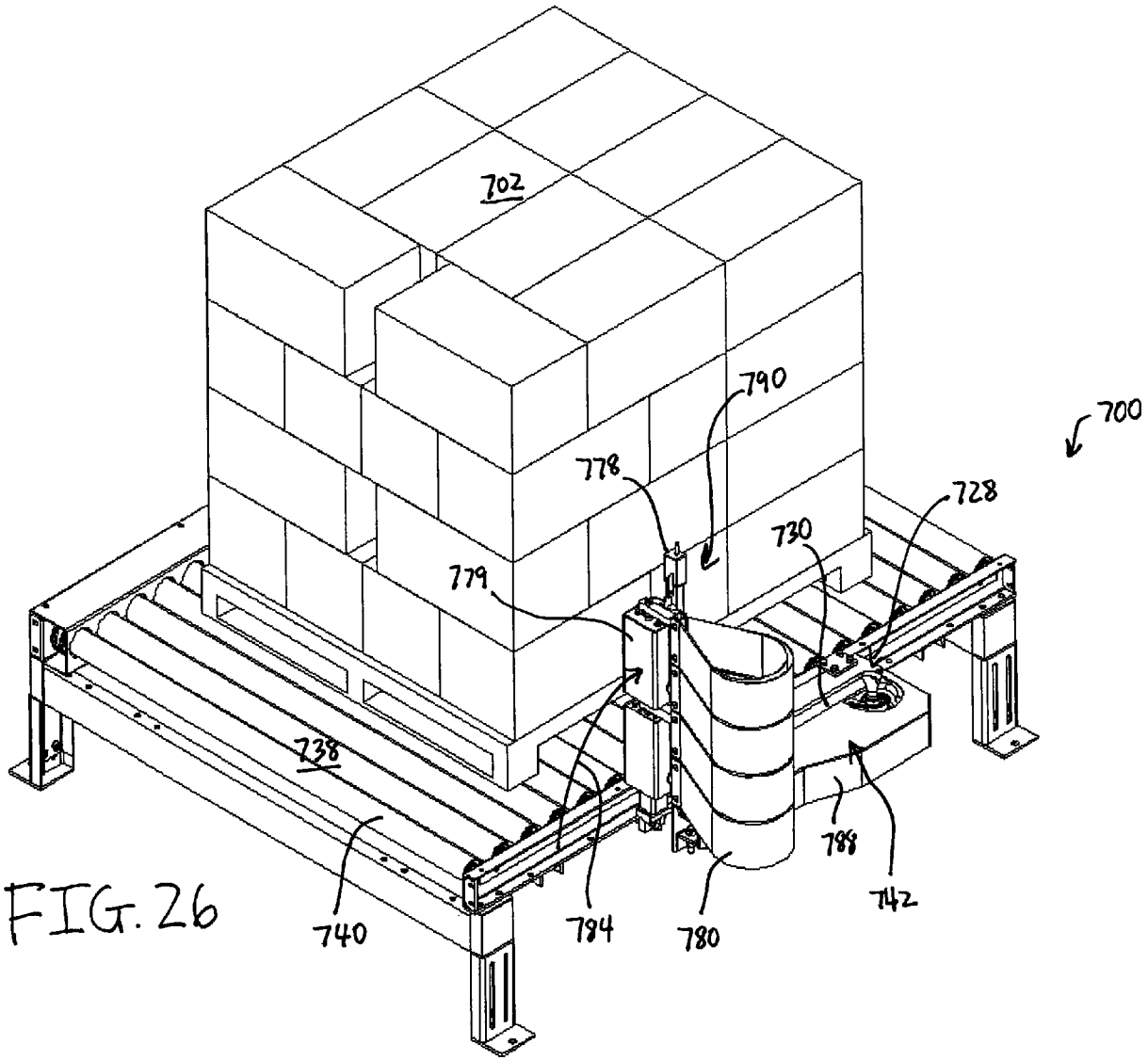
FIG. 26 is a perspective view of components of the wrapping apparatus of FIG. 22, according to one aspect of the present disclosure.
Figure 27:
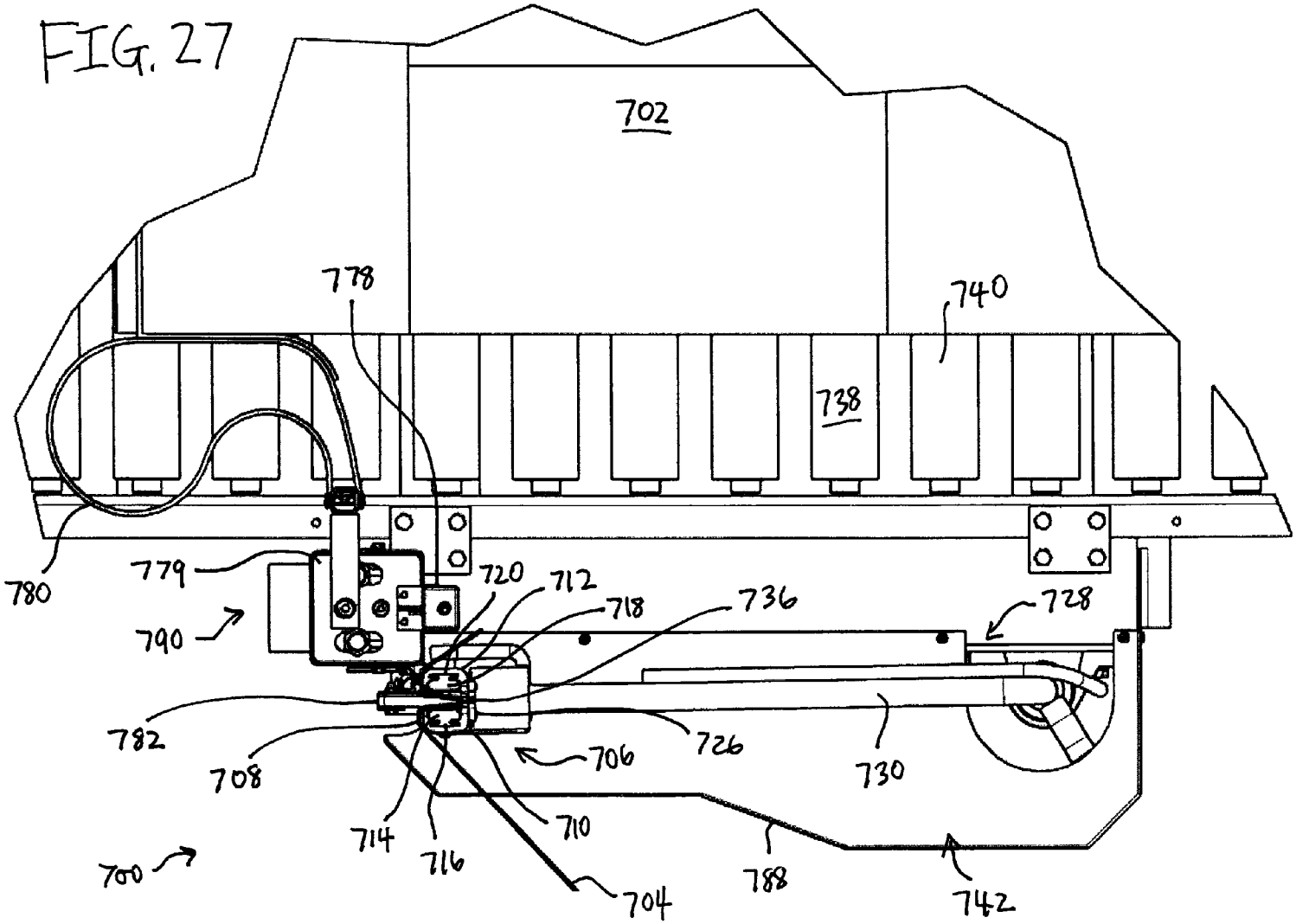
FIG. 27 is another top view of components of the wrapping apparatus of FIG. 22 in use, according to one aspect of the present disclosure.
Figure 28:
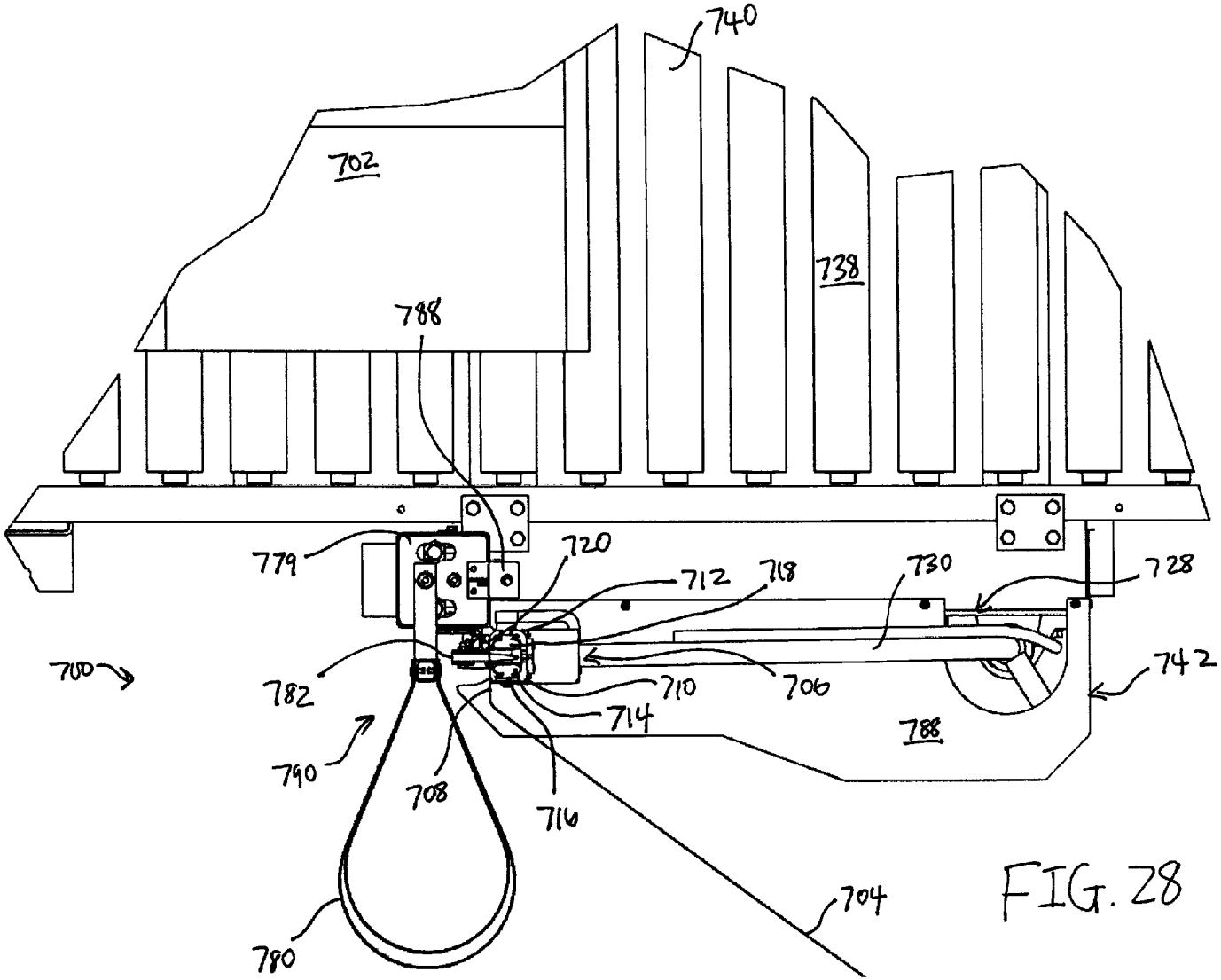
FIG. 28 is another top view of components of the wrapping apparatus of FIG. 22 in use, according to one aspect of the present disclosure.

Once packaging material holder 706 has reached the distant position, rotatable body 779, cutting assembly 778, wipedown assembly 780, and insertion tool 782, may be actuated. Rotatable body 779, cutting assembly 778, wipedown assembly 780, and insertion tool 782 may rotate from the substantially horizontal position shown in FIGS. 22-24 to the substantially vertical position shown in FIGS. 25 and 26. As shown in FIG. 25, when in the substantially vertical position, insertion tool 782 may force packaging material 704 between jaws 710 and 712, and thus, into restricted jaw opening 736 of packaging material holder 706. A controller (not shown) may initiate pressurization of first inflatable bladder 714 and second inflatable bladder 718 such that a portion of packaging material 704 may be clamped by packaging material holder 706 between the opposing surfaces of bladders 714 and 718. Alternatively, at least one of bladders 714 and 718 may be at least partially pressurized as insertion tool 782 inserts packaging material 704 into restricted jaw opening 736.

Cutting assembly 778 may sever packaging material 704 that extends between load 702 and the packaging material dispenser to form a new leading end portion 708 that is held by packaging material holder 706. When in the substantially vertical position, wipedown assembly 780 may rotate from the position shown in FIGS. 25 and 26 to the position shown in FIG. 27, to press a new tail end portion 707 of packaging material 704 onto the layers of packaging material 704 wrapped about load 702. Load 702 may be conveyed out of the wrapping area. Wipedown assembly 780 may be rotated away to the position shown in FIG. 28. Rotatable body 779, cutting assembly 778, wipedown assembly 780, and insertion tool 782 may rotate from the position shown in FIG. 28 to the position shown in FIG. 29, thus withdrawing insertion tool 782 from between first inflatable bladder 714 and second inflatable bladder 718, leaving packaging material 704 clamped, as shown in FIG. 29. At least one of bladders 714 and 718 may be at least partially depressurized to assist with the withdrawal of insertion tool 782, while maintaining a sufficient clamping force to keep packaging material 704 clamped in packaging material holder 706. With leading end portion 708 clamped by packaging material holder 706, apparatus 700 may be ready to wrap the next load by repeating the steps discussed above.

Industrial Applicability

The disclosed wrapping apparatuses and methods may be useful for wrapping loads, and in particular, for the automatic wrapping of loads. The use of the above-described pneumatic packaging material clamps to grip packaging material, and the use of the above-described support arm assemblies, provide clamping in a robust manner, in that they may clamp packaging material in a wide variety of conditions. Furthermore, they may provide clamping without producing an undesirable amount of "tenting" (i.e., stretching of packaging material overwrapping the packaging material clamps) during wrapping, due to the distance between the clamps and their respective loads during wrapping. This may result in a reduction in wasted packaging material, and a reduction in the number of loosely wrapped loads. Furthermore, the pneumatic packaging material clamps require few components. As such, they are relatively inexpensive, and may be easy to maintain. In addition, it is contemplated that wrapping apparatuses without clamps, or those with known clamps, may be retrofitted to include the above-described pneumatic packaging material clamps.

Other embodiments will be apparent to those skilled in the art from consideration of the specification and practice of the disclosed embodiments herein. It is intended that the specification and examples be considered as exemplary only, with a true scope and spirit of the disclosure being indicated by the following claims.

What is claimed is:

1. An apparatus for clamping packaging material, comprising:

a packaging material holder, including a first jaw, a second jaw, opposing the first jaw, and a jaw opening between the first and second jaws, configured to receive a portion of packaging material; and a packaging material insertion tool configured to insert the portion of packaging material into the jaw opening for clamping; at least a portion of the packaging material insertion tool received between the first and second jaws;

wherein the insertion tool is a plate configured to engage a portion of the packaging material to force the portion of the packaging material into the jaw opening as the plate is inserted into the jaw opening.

2. The apparatus of claim 1, wherein the jaw opening is a restricted jaw opening.

3. The apparatus of claim 1, wherein the packaging material holder includes at least one inflatable bladder mounted on one of the first and second jaws, the at least one inflatable bladder being configured to hold packaging material between the first and second jaws when the at least one inflatable bladder is pressurized.

4. The apparatus of claim 1, wherein the packaging material holder includes a pair of inflatable bladders, one of the pair of inflatable bladders being mounted on the first jaw, the other of the pair of inflatable bladders being mounted on the second jaw, wherein pressurization of the pair of inflatable bladders brings surfaces of the pair of inflatable bladders together to clamp the packaging material in the jaw opening.

5. The apparatus of claim 4, wherein the pair of inflatable bladders is configured to clamp a rope of packaging material.

6. The apparatus of claim 4, wherein the pair of inflatable bladders is configured to receive a rope of packaging material for insertion into a space located at a top portion of the jaw opening while the pair of inflatable bladders is pressurized.

7. The apparatus of claim 1, wherein the packaging material holder includes a packaging material cutter configured to cut a portion of packaging material extending out of the jaw opening.

8. The apparatus of claim 1, wherein the insertion tool is at least partially formed of a low-friction material.

9. The apparatus of claim 8, wherein a frictional force between the insertion tool and the packaging material is less than a frictional force between the packaging material holder and the packaging material.

10. The apparatus of claim 9, wherein differences in the frictional forces allow the plate to be withdrawn from the jaw opening while leaving the portion of the packaging material clamped in the jaw opening.

11. The apparatus of claim 1, further including a support arm assembly configured to movably support the packaging material holder.

12. The apparatus of claim 11, wherein the support arm assembly is configured to move the packaging material holder between a distant position and a near position.

13. The apparatus of claim 12, wherein the support arm assembly is configured to swing the packaging material holder through an arc to move the packaging material holder between the distant position and the near position.

14. The apparatus of claim 12, wherein the support arm assembly is configured to move the packaging material holder along a substantially linear path between the distant position and the near position.

15. An apparatus for clamping packaging material, comprising:

a packaging material holder, including a first jaw, a second jaw, opposing the first jaw, and a jaw opening between the first and second jaws, configured to receive a portion of packaging material; and a packaging material insertion tool configured to insert the portion of packaging material into the jaw opening for clamping; at least a portion of the packaging material insertion tool received between the first and second jaws;

wherein the insertion tool is a cantilevered element configured to engage a portion of the packaging material to force the portion of the packaging material into the jaw opening as the element is inserted into the jaw opening.

16. The apparatus of claim 15, wherein the cantilevered element is configured to be withdrawn from the jaw opening while leaving the packaging material clamped in the jaw opening.

17. The apparatus of claim 15, wherein the cantilevered element is withdrawn from the packaging material holder in a substantially vertical direction after the packaging material has been inserted in the jaw opening.

18. An apparatus for clamping packaging material, comprising:

a packaging material holder, including a first jaw, a second jaw, opposing the first jaw, and a jaw opening between the first and second jaws, configured to receive a portion of packaging material;

a packaging material insertion tool configured to insert the portion of packaging material into the jaw opening for clamping; at least a portion of the packaging material insertion tool received between the first and second jaws; and a support arm assembly configured to movably support the packaging material holder;

wherein the packaging material holder is coupled to the support arm assembly by a wrist portion, the wrist portion being configured to allow the packaging material holder to rotate relative to the support arm assembly.

19. An apparatus for automatically positioning a leading end portion of a length of packaging material proximate a load, comprising:

a packaging material holder including a jaw opening configured to receive the leading end portion;

an insertion tool configured to insert the leading end portion into the jaw opening for clamping; and a support arm configured to movably support the packaging material holder and allow movement of the packaging material holder in a direction toward an axis of rotation for wrapping the load to position the leading end portion proximate the load.

20. The apparatus of claim 19, wherein the packaging material holder includes opposing jaws fixed relative to each other, the jaw opening being a space between the opposing jaws.

21. The apparatus of claim 19, wherein the packaging material holder includes opposed inflatable bladders configured to fill the jaw opening and clamp the leading end portion of packaging material between the bladders when pressurized.

22. The apparatus of claim 21, wherein the inflatable bladders define therebetween a space located at a top portion of the jaw opening when the inflatable bladders are pressurized, the space being configured to receive the leading end portion of packaging material.

23. The apparatus of claim 19, wherein the insertion tool is at least partially formed of a low-friction material.

24. The apparatus of claim 23, wherein a frictional coefficient between the insertion tool and the packaging material is less than a frictional coefficient between the packaging material holder and the packaging material.

25. The apparatus of claim 24, wherein differences between the frictional coefficients allows the insertion tool to be withdrawn from the jaw opening while leaving the leading end portion clamped in the jaw opening.

26. The apparatus of claim 19, wherein the insertion tool is a plate configured to force the leading end portion into the jaw opening as the plate is inserted into the jaw opening.

27. The apparatus of claim 19, wherein the insertion tool is a cantilevered element configured to force the leading end portion of the packaging material into the jaw opening as the rod is inserted into the jaw opening.

28. The apparatus of claim 27, wherein the cantilevered element is configured to be withdrawn from the jaw opening while leaving the leading end portion clamped in the jaw opening.

29. The apparatus of claim 27, wherein the cantilevered element enters the jaw opening at one side and exits the jaw opening from above the jaw opening to insert the leading end portion in the jaw opening.

30. The apparatus of claim 27, wherein the cantilevered element is withdrawn from the packaging material holder in a substantially vertical direction after the leading end portion has been inserted in the jaw opening.

31. The apparatus of claim 19, wherein the support arm is configured to rotate the packaging material holder through an arc to move the packaging material holder toward the load and away from the load.

32. The apparatus of claim 19, wherein the support arm is configured to move the packaging material holder along a substantially linear path toward the load and away from the load, wherein the path is substantially normal to a surface of the load.

33. The apparatus of claim 19, wherein the packaging material holder is coupled to the support arm by a wrist portion, the wrist portion being configured to allow the packaging material holder to rotate relative to the support arm assembly.

34. The apparatus of claim 19, wherein the jaw opening is defined by rigid jaw portions that are fixed relative to one another.

35. A method for automatically connecting a leading end portion of a length of packaging material to a load, comprising:

moving a packaging material holder in a direction toward an axis of rotation for wrapping the load to a position adjacent to a side of the load, the packaging material holder having a leading end of the packaging material clamped between jaws of the packaging material holder;

overwrapping the leading end; releasing the overwrapped leading end; and automatically inserting a new leading end between the jaws with an insertion tool at an end of a wrapping cycle.

36. The method of claim 35, wherein moving the packaging material holder includes pressurizing at least one inflatable bladder coupled to at least one of the jaws to clamp the leading end.

37. The method of claim 35, wherein moving the packaging material holder includes pressurizing a pair of inflatable bladders coupled to the jaws, wherein pressurizing the pair of inflatable bladders causes the inflatable bladders to fill a jaw opening between the jaws to clamp the leading end.

38. The method of claim 35, wherein moving the packaging material holder includes rotating the packaging material holder along an arc.

39. The method of claim 38, wherein the arc lies in a plane substantially parallel to a side of the load.

40. The method of claim 38, wherein the arc lies in a plane substantially perpendicular to a side of the load.

41. The method of claim 35, wherein moving the packaging material holder includes moving the packaging material holder substantially linearly.

42. The method of claim 35, wherein moving the packaging material holder includes providing relative rotation between a packaging material dispenser and the packaging material holder to create a pulling force on the leading end that pulls the packaging material holder.

43. The method of claim 35, wherein releasing the overwrapped leading end includes depressurizing a pair of inflatable bladders configured to clamp the leading end between the jaws.

44. The method of claim 35, wherein releasing the overwrapped leading end includes moving the packaging material holder away from the load.

45. A method for automatically clamping a leading end portion of a length of packaging material, comprising:

cutting a length of film extending from a corner of a wrapped load to a packaging material dispenser to form a leading end portion of packaging material extending from the packaging material in the packaging material dispenser, and a tail end portion extending to the wrapped load;

actuating an insertion tool to insert the leading end portion into a packaging material holder, at least a portion of the insertion tool received in the packaging material holder; and clamping the leading end portion with the packaging material holder.

46. The method of claim 45, further including actuating a wipedown assembly to press the tail end portion onto the wrapped load.

47. The method of claim 45, wherein inserting the leading end portion into the packaging material holder includes forcing the leading end portion into a jaw opening of the packaging material holder with the insertion tool.

48. The method of claim 45, wherein clamping the leading end portion includes pressurizing at least one inflatable bladder of the packaging material holder to exert a clamping force on the leading end portion.

49. The method of claim 45, further including withdrawing the insertion tool from the packaging material holder once the leading end portion has been clamped.

50. The method of claim 49, wherein withdrawing the insertion tool includes moving the insertion tool in a direction opposite to a direction taken during insertion of the leading end.

51. The method of claim 49, wherein withdrawing the insertion tool includes moving the insertion tool in a direction transverse to a direction taken during insertion of the leading end.

52. The method of claim 45, further including moving the packaging material holder toward the load before inserting the leading end portion.

53. A method for wrapping a load with packaging material, comprising:

positioning a leading end of film in a restricted jaw opening of a packaging material holder;

pressurizing at least one portion of the packaging material holder to fix the leading end relative to the restricted jaw opening;

wrapping packaging material around the load and the packaging material holder holding the leading end; and depressurizing the at least one portion of the packaging material holder to release the leading end.

54. An apparatus for wrapping a load with packaging material, comprising:

a packaging material holder, including a first jaw, a second jaw, opposing the first jaw, and a jaw opening between the first and second jaws, the jaw opening configured to receive a portion of packaging material;

an assembly configured to engage the packaging material and insert the portion of packaging material into the jaw opening for clamping, at least a portion of the assembly received in the jaw opening; and a support assembly configured to support the packaging material holder;

wherein the support assembly includes a rotatable support arm configured to rotate the packaging material holder toward and away from the load; and wherein the support assembly includes a wrist portion allowing relative rotation between the packaging material holder and the rotatable support arm about a longitudinal axis of the rotatable support arm.

55. The apparatus of claim 54, wherein the assembly is configured to rotate about a first axis.

56. The apparatus of claim 55, wherein the axis is substantially perpendicular to a side of the load.

57. The apparatus of claim 55, wherein the axis is substantially parallel to a side of the load.

58. The apparatus of claim 54, wherein the assembly is configured to travel substantially linearly towards and away from a side of the load.

59. The apparatus of claim 54, further including a packaging material dispenser configured to dispense packaging material to wrap the load.

60. The apparatus of claim 59, wherein the packaging material dispenser travels along a path defining a boundary of a wrapping zone.

61. The apparatus of claim 60, wherein at least a portion of the assembly is configured to move into the wrapping zone from outside the wrapping zone to insert the portion of packaging material into the jaw opening.

62. The apparatus of claim 60, wherein at least a portion of the assembly always remains in the wrapping zone.

63. The apparatus of claim 59, wherein the assembly is positioned so that packaging material passes over the assembly as packaging material dispenser dispensed packaging material to wrap the load.

64. The apparatus of claim 54, wherein the assembly includes an insertion tool configured to insert the portion of packaging material into the jaw opening.

65. The apparatus of claim 54, wherein the assembly includes a cutting assembly configured to cut packaging material.

66. The apparatus of claim 54, wherein the assembly includes a rotatable wipedown assembly configured to press packaging material against a side of the load.

67. The apparatus of claim 54, wherein at least a portion of the first jaw is fixed elative to at least a portion of the second jaw.

68. The apparatus of claim 54, further including an actuation assembly configured to rotate the rotatable support arm.

69. The apparatus of claim 68, wherein the actuation assembly includes a piston configured to engage at least a portion of the rotatable support arm.

70. The apparatus of claim 54, wherein the rotatable support arm is spring-biased toward a first position.

71. The apparatus of claim 54, wherein the support assembly includes a support arm configured to move the packaging material holder in a substantially linear path toward and away from the load.

72. A method for automatically clamping packaging material, comprising:

engaging at least a portion of a length of packaging material extending from a corner of a wrapped load to a packaging material dispenser with an assembly;

moving at least a portion of the assembly and the engaged packaging material into a jaw opening between a first jaw and a second jaw of a packaging material holder; and clamping the engaged packaging material in the jaw opening of the packaging material holder.

73. The method of claim 72, wherein engaging the at least a portion of the length of packaging material with the assembly includes rotating the assembly into engagement with the at least a portion of the length of packaging material.

74. The method of claim 73, wherein rotating the assembly includes rotating the assembly from a substantially horizontal position to a substantially vertical position.

75. The method of claim 73, wherein rotating the assembly includes rotating the assembly from a first position to a second position along a substantially horizontal plane.

76. The method of claim 73, wherein engaging the at least a portion of the length of packaging material with the assembly includes linearly moving the assembly into engagement with the at least a portion of the length of packaging material.

77. The method of claim 72, wherein engaging the at least a portion of the length of packaging material with the assembly includes engaging the at least a portion of the length of packaging material with an insertion tool configured to move the engaged packaging material into the jaw opening.

78. The method of claim 72, wherein engaging the at least a portion of the length of packaging material with the assembly includes engaging the at least a portion of the length of packaging material with a cutting assembly configured to cut the length of packaging material to form a leading end portion and a tail end portion.

79. The method of claim 78, wherein the leading end portion is moved into the jaw opening by an insertion tool.

80. The method of claim 78, wherein the tail end portion is wiped onto the wrapped load by a wipedown assembly.

81. The method of claim 72, wherein clamping includes holding the engaged packaging material in the jaw opening between inflatable bladders.

82. A method for wrapping a load with packaging material, comprising:

pressurizing at least one inflatable element to at least partially fill an opening in a rigid element of a packaging material holder; and positioning packaging material in the opening with an element;

wherein positioning the packaging material in the opening includes engaging packaging material with the element, and inserting the element into the opening.

83. The method of claim 82, wherein pressurizing the at least one inflatable element includes pressurizing a first bladder coupled to the rigid element, and pressurizing a second bladder coupled to the rigid element.

84. The method of claim 83, wherein pressurizing the first and second bladders moves surfaces of the first and second bladders towards one another.

85. The method of claim 82, wherein the at least one inflatable element is pressurized after the packaging material is positioned in the opening.

* * * * *

UNITED STATES PATENT AND TRADEMARK OFFICE

CERTIFICATE OF CORRECTION

PATENT NO. : 8,695,312 B2
APPLICATION NO. : 12/473191
DATED : April 15, 2014
INVENTOR(S) : Richard L. Johnson et al.

It is certified that error appears in the above-identified patent and that said Letters Patent is hereby corrected as shown below:

In the Specification:

Column 1,
Line 9 reads "for wrapping a load, and more particularly, to a method and" and should read -- for wrapping a load and, more particularly, to a method and --.

Column 20,
Line 12 reads "useful for wrapping loads, and in particular, for the automatic" and should read -- useful for wrapping loads and, in particular, for the automatic --.

In the Claims:

Claim 25, Column 22
Lines 42-43 read "wherein differences between the frictional coefficients allows the" and should read -- wherein differences between the frictional coefficients allow the --.

Claim 67, Column 25
Line 34 reads "the first jaw is fixed elative to at least" and should read -- the first jaw is fixed relative to at least --.

Signed and Sealed this
Nineteenth Day of August, 2014

Michelle K. Lee

Michelle K. Lee
*Deputy Director of the United States Patent and Trademark Office*